US005955850A

United States Patent [19]

Yamaguchi et al.

[11] Patent Number: 5,955,850

[45] Date of Patent: Sep. 21, 1999

[54] FIELD EMISSION DISPLAY DEVICE

[75] Inventors: Satoshi Yamaguchi; Haruhisa Hirakawa, both of Mobara; Kazuhiko Tsuburaya; Masaharu Tomita, both of Mobarashi; Tatsuo Yamamura, Mobara, all of Japan

[73] Assignee: Futaba Denshi Kogyo K.K., Mobara, Japan

[21] Appl. No.: 08/917,744

[22] Filed: Aug. 27, 1997

[30] Foreign Application Priority Data

Aug. 29, 1996 [JP] Japan ..... 8-245434

[51] Int. Cl.[6] ..... H01J 1/30

[52] U.S. Cl. ..... 315/495; 313/336

[58] Field of Search ..... 313/495, 496, 313/497, 422, 336, 351, 309

[56] References Cited

U.S. PATENT DOCUMENTS 5,430,347 7/1995 Kane et al. ..... 313/422

5,561,345 10/1996 Kuo ..... 313/495

5,703,610 12/1997 Kishino et al. ..... 313/495

*Primary Examiner*—Nimeshkumar D. Patel

*Attorney, Agent, or Firm*—Oblon, Spivak, McClelland, Maier & Neustadt, P.C.

[57] ABSTRACT

A field emission display device of the type driven on a high anode voltage to accelerate effectively emitted electrons to the anode, thus providing high brightness as well as no leakage of glowed light. Cone emitters are formed on the cathode electrode laying on a cathode substrate. An insulating layer as well as first gate electrodes are formed on the portions where the emitters are not formed. Another insulating layer if formed on the first gate electrodes. Second gate electrodes (or focusing electrodes) with openings are formed over the first gate electrodes. Plural lines of the emitters are formed in parallel in the emitter area corresponding one pixel. The emitters are aligned to each of the openings. An anode voltage of 2kV to 5kV is applied to the anode electrode (not shown). The electrons from the emitters are focused by the focusing electrode and the reaches the anode electrode.

15 Claims, 19 Drawing Sheets

FIELD EMISSION DISPLAY DEVICE

BACKGROUND OF THE INVENTION

1. Field of the Invention

This invention relates to a display device (panel) using field emission cathodes (hereinafter sometimes referred to as FECs) acting as electron emission sources, (hereinafter sometimes referred to as a field emission display (FED)).

2. Description of the Related Art

When the electric field at a surface of a metal or semiconductor is as large as $10^9$ V/m, electrons pass through the potential barrier because of the tunnel effect, thus entering an evacuated space at room temperatures. This phenomenon is called field emission. The cathode emitting electrons utilizing that principle is referred to as a field emission cathode (FEC).

The structure of a field emission cathode called a Spindt type cathode is schematically shown in FIG. 19. Referring to FIG. 19, a cathode electrode 102 of a metal such as aluminum is formed on the cathode substrate 101 such as glass. Cone emitters 105 of a metal such as molybdenum are formed on the cathode electrode 102. An insulating layer 103 such as silicon dioxide ($SiO_2$) is formed on the remaining portions of the cathode substrate 102 where the emitters 105 are not formed. A gate electrode (or lead-out gate electrode) 104 is formed over the gate insulating layer 104. Openings 106 are formed through the gate electrode 104 and the insulating layer 103. Cone emitters 105 are respectively positioned in the openings 106. The edges of cone emitters 105 are viewed in the openings 106.

The pitch between the cone emitters 105 can be less than 10 $\mu$m. Several ten thousand to several hundred thousand emitters can be formed on a single substrate. The distance between the gate electrode 104 and the edge of the cone emitter 105 is set in submicrons. Hence, when a voltage Vg of several 10 volts is applied between the gate electrode 104 and the emitter 105, electrons are field emitted from the emitter 105. When a positive voltage Va is applied to the anode electrode 109 placed so as to confront the gate electrode 104, the anode electrode 109 can collect electrons field-emitted from the emitter 105. In such a condition, a florescent substance coated on the anode 109 which collects electrons field-emitted from the emitter 105 can be glowed. A display device including field emission cathodes can be fabricated by utilizing the above-mentioned principle, This display device is called a field emission display device (panel).

Some high resolution field emission display devices have been proposed that include means for focusing electrons emitted from the emitter of which its locus has a predetermined divergent angle to prevent a leakage of glowed light.

FIG. 20 illustrates the configuration of the above-mentioned field emission display (FED) (refer to Japanese patent Laid-open Publication (Tokkai-Hei) No. 7-104679). In this FED, second gate electrodes (focusing electrodes) 107 are formed for an emitter array corresponding to each pixel formed of plural emitters. Electrons emitted from the emitter array are focused by applying a negative potential to the second gate electrode 107. In FIG. 20, the second gate electrode 107 is formed in a grid pattern so as to surround an array of plural emitters 105. Positive potentials are respectively applied to the anode electrode 109 and the first gate electrode 104 while a negative potential is applied to the second gate electrode 107. The cathode electrode 102 on which plural emitters 105 acting as one pixel, as shown in FIG. 20, are arranged is a unit area. Numeral 111 represents a TFT (thin film transistor) section to drive the cathode electrode 102 in a matrix mode. Electrons emitted from a selected unit area are focused by the second gate electrode 107 and then hit the fluorescent substance 108 formed on the anode 109 with no diffusion.

Japanese patent Laid-open Publication (Tokkay-Hei) No. 6-338274 discloses that the focusing electrode arranged between stripe gate electrodes as well as the adjacent anode electrode are switched at an off level to focus the locus of electrons emitted from an emitter array. FIG. 21 is a diagram used for explaining the above-mentioned field emission display device. FIG. 21(*a*) is a cross-sectional view showing the field emission display device. FIG. 21(*b*) is a diagram showing the locus of electrons emitted from an emitter array.

Referring to FIG. 21(*a*), the cathode electrode 102 is formed in a stripe form on the cathode substrate 101. The gate electrodes 104 in a stripe form are arranged on the cathode substrate 102 through an insulating layer formed on the cathode electrode 102 so as to be perpendicular to the cathode electrode 102. Stripe focusing electrodes 117 are arranged between the stripes of the gate electrode 104. The first anode electrode 118 and the second anode electrodes 119 are in a stripe form and are formed on the anode substrate 110. R fluorescent substance, G fluorescent substance, and B fluorescent substance are sequentially coated on anode electrodes. Numeral 130 represents an anode lead-out electrode A1 connected to each stripe of the first anode electrode 118. Numeral 131 represents an anode lead-out electrode A2 connected to each stripe of the second anode electrode 119. Numeral 134 represents a cathode lead-out electrode derived from each stripe of the cathode electrode 102.

A constant negative voltage is always applied to the stripe focusing electrode 117 via the electrode 135 to focus the locus of electrons emitted from each emitter array 112, as shown in FIG. 21(*b*). The anode electrodes 118 and 119 are shaped in a stripe form. A voltage of 0 volts is applied to anodes not driven so that a leakage of glowed light can be prevented. In FIG. 21(*b*), solid lines represent a potential distribution while broken lines represent the electron locus.

FIG. 22 illustrates a field emission display device in which means for focusing an emitted electron beam is prepared for each emitter in a cathode (refer to Japanese Patent Laid-open Publication (Tokkai-Hei) No. 7-29484). In FIG. 22, an insulating layer 103' is additionally laid on the gate electrode (lead-out gate electrode) 104. A focusing electrode (second gate electrode) 107 having a round opening 120 is formed on the insulating layer 103'. That is, the focusing electrode 107 is formed so as to surround the emitter 105. A lower voltage that than to the gate electrode 104 is applied to the focusing electrode 107 so that electrons emitted from the each emitter 105 is focused. Hence the focusing electrode 107 can focus the electrons emitted from the emitter 105.

The focusing electrode 107 traps part of electrons emitted from the emitter 105 and decreases the amount of electrons which reaches the anode electrode, thus increasing ineffective current. The potential of the focusing electrode affects the electric field produced by the first gate electrode, thus decreasing the amount of electrons emitted from the emitter. In order to prevent such problems, the invention disclosed in the prior art publication No. 7-29484, the expression $D2=(1.2-2)\times D1$ is satisfied, where D1 is the diameter of the opening 106 formed on the lead-out gate electrode 107 and D2 is the diameter of the opening 120 formed on the focusing electrode 107. Thus, electrons emitted from the emitter are focused while the ineffective current flowing into the focusing electrode 107 can be reduced.

The electrons thus emitted reach the anode electrode to glow the fluorescent substance layer coated on the anode electrode. Fluorescent substance dots formed on the anode electrodes in a typical full-color display is illuminated in FIG. 23. In FIG. 23, S1 represents an area corresponding to one pixel, and is, for example, 300 μm in length×100 μm in width. S2 represents a fluorescent substance dot which is 220 μm in length×80 μm in width.

As described above, the conventional field emission display device is usually driven on a low anode voltage of less than 1 kV. Use of low anode voltage allows the gap between the anode and cathode to be narrowed to 150 μm to 300 μm, thus realizing a very thin display device.

The short distance between the anode and the cathode allows electrons emitted from the emitter to reach the anode with a relatively small divergent width. Hence, the focusing electrode surrounding an emitter array for one pixel as shown in FIG. 20 can focus electrons emitted.

In the high-resolution display, electrons emitted from the emitter array can be focused at the same time by switching adjacent gates and an adjacent anode to an off level, as shown in FIG. 21.

However, in the above-mentioned low-voltage-type field emission display devices, a large anode current (e.g. an anode current density of 50 $mA/cm^2$ to 100 $mA/cm^2$) is needed to obtain a predetermined brightness. Generally, the fluorescent substance has a property which shows a low luminous efficiency at large current values.

Recently, field effect display devices which use an anode voltage of more than several thousand kV have been developed to obtain higher brightness at low power consumption. In the high-voltage-type display devices, it is needed that the gap between the anode substrate and the cathode substrate is widened to prevent the cathode-to-anode discharge. This requires means for focusing electrons emitted from the emitter.

Because of the use of a high anode voltage, it is difficult to subject the anode patterned in a stripe form shown in FIG. 21 to a switching operation.

The focusing electrode prepared for each emitter as shown in FIG. 22 does not need the anode switching operation. In this case, there is the disadvantage in that large ineffective current flowing into the first or second gate electrode reduces electrons reaching the anode. That is, the relationship between the size of the opening formed in the first gate electrode and the size of the opening of the second gate electrode is defined in the example shown in FIG. 22. However, since the divergence or diffusion of electrons emitted from the emitter is not considered, the ineffective current flowing into the second gate electrode cannot be sometimes reduced although the emitted electrons can be focused.

SUMMARY OF THE INVENTION

It is the object of the invention is to provide a field emission display device of which its anode is driven on a high voltage and that can minimize a decrease in electron flow emitted from an emitter, thus focusing the electron flow without increasing ineffective current.

In order to accomplish the above-mentioned object, a field emission display device comprises a cathode substrate on which cathode electrodes are formed; emitters arranged on each of the cathode electrodes; first gate electrodes respectively placed near the emitters, for extracting electrons; second gate electrodes each having an opening for focusing electrons, the opening being formed above a first gate electrode a distance L2 apart from the first gate electrode, the shortest distance between the edge of the opening and the center of an emitter being set to d1; and an anode substrate arranged so as to confront the cathode substrate, the anode substrate having anode electrodes each on which a fluorescent substance is coated; wherein the distance d1 is expressed by the inequality of $0.5\ d \leqq d1 \leqq 3d$, where d is a divergent radius of the locus of electrons emitted from the emitter a distance L2 away from the emitter in the case of the existence of no second gate electrode.

In a first embodiment of said emitters is placed in the opening, the opening being a round opening;

each of said emitters is placed at a position somewhat shifted from the center of the round opening;

plural rows of the round openings are arranged for one pixel;

In a second embodiment opening is a slit-like opening and a line of plural emitters are placed in the slit-like opening;

the emitter is placed at a position somewhat shifted from the center of the slit-like opening;

the slit-like opening is formed of plural subslits;

In a further embodiment field emission display device further comprises plural slit-like openings formed in parallel for one pixel;

an emitter positioned at the end of a line of the emitters arranged in the slit-like opening is arranged adjacent to the end of the slit-like opening; and different voltages are respectively applied to the second gate electrode associated with a right side emitter and the gate electrode associated with a left side emitter.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 4(*b*) is a cross-sectional view showing the opening of a focusing electrode in a field emission display device according to the present invention;

FIG. 6(*b*) is a graph showing relations between second gate voltage and luminous spot size, plotted for ratio of the radius of an opening in a focusing electrode to divergent width as parameter;

FIG. 7(*b*) is an enlarged perspective view partially showing an emitter array of the cathode substrate in a field emission display device, according to the second embodiment of the present invention;

FIG. 8(*b*) is a graph showing relations between second gate voltage and luminous spot size, plotted for ratio of radius of an opening in a focusing electrode to divergent width as parameter, in a field emission display device according to the second embodiment of the present invention;

FIGS. 9(*b*) and 9(*c*) are plan views each showing the configuration of a field emission cathode in a field emission display device according the third embodiment of the present invention;

FIGS. 16(*b*) and 16(*c*) are plan views each showing a field emission cathode in a field emission display device of another embodiment of the present invention;

FIG. 21(*b*) is a diagram showing an electron beam locus of an emitter array in the conventional field emission display element;

DETAILED DESCRIPTION OF THE PREFERRED EMBODIMENTS

The embodiments according to the present invention will now be described below with reference to the attached drawings.

In conventional field emission display devices, the anode voltage Va is less than 1 kV (e.g. 200 V to 500 V in many cases). However, according to the field emission display device of the present invention, it is premised that the anode voltage Va is boosted up to several kV (e.g. 2 kV to 10 kV in many cases) to obtain sufficient brightness. Generally speaking, if the anode voltage Va is boosted ten times, the anode current Ia become 1/10 to supply the same anode input power. In small current areas and high voltage areas, the luminous efficiency of a fluorescent substance is improved 5 to 10 times. This advantage allows the anode current to reduce several %, in comparison with the low-voltage operation, so that the number of emitters can be reduced several %.

Because of a decrease in number of emitters, sufficient space can be secured to form focusing electrodes (to be described later). A small number of emitters integrated can reduce the stray capacitance, thus largely reducing ineffective power consumed to charge and discharge the stray capacitance.

The field emission display device according to the first embodiment of the present invention will be described below.

Figure 1:
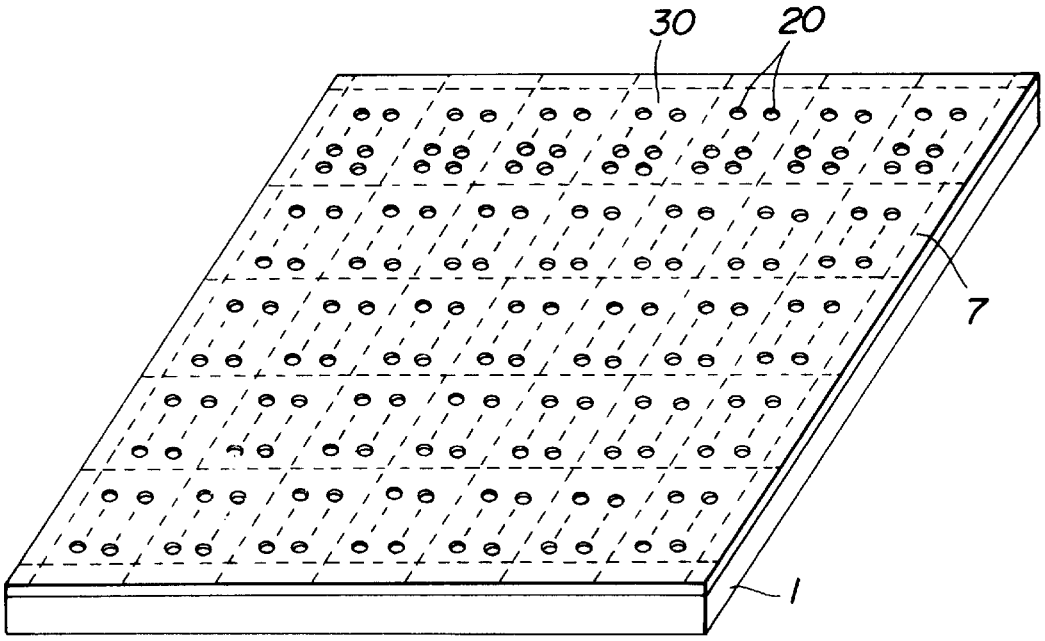
FIG. 1 is a perspective view showing the cathode substrate used in a field emission display device according to a first embodiment of the present invention.
Figure 2:
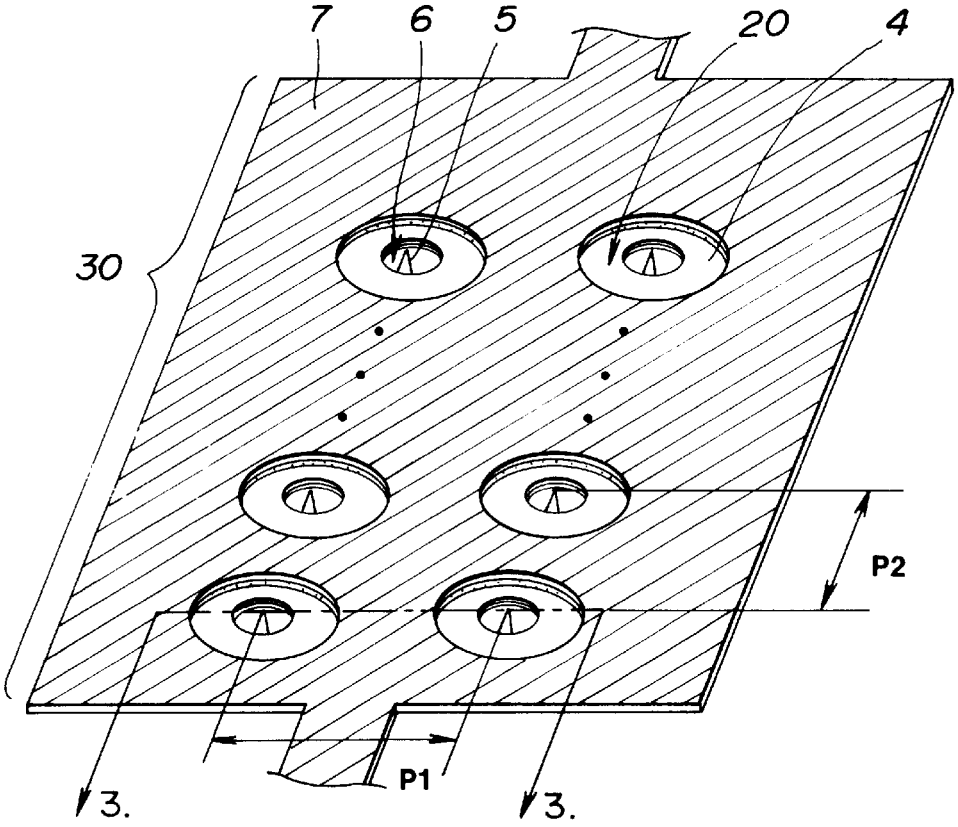
FIG. 2 is an enlarged perspective view showing the portion corresponding to one pixel of the cathode substrate in a field emission display device according to the first embodiment of the present invention.
Figure 3:
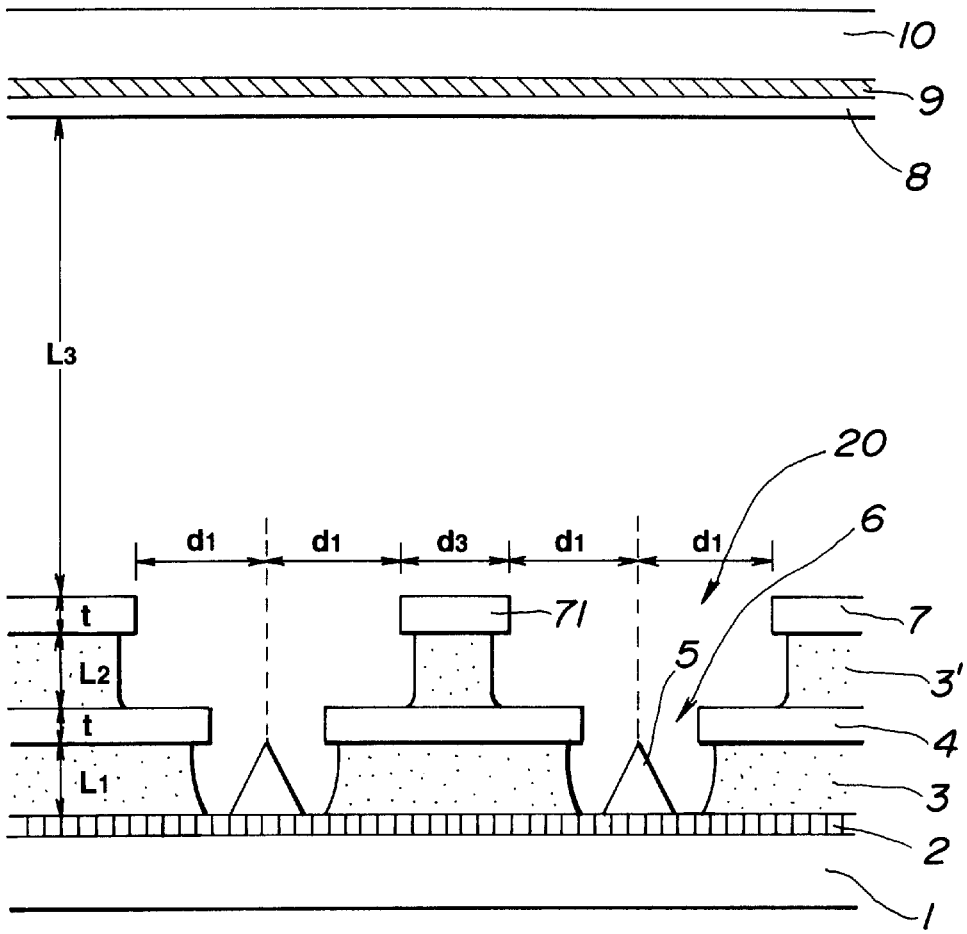
FIG. 3 is a side cross-sectional view partially showing an emitter array in a field emission display device according the first embodiment of the present invention.
Figure 21A:
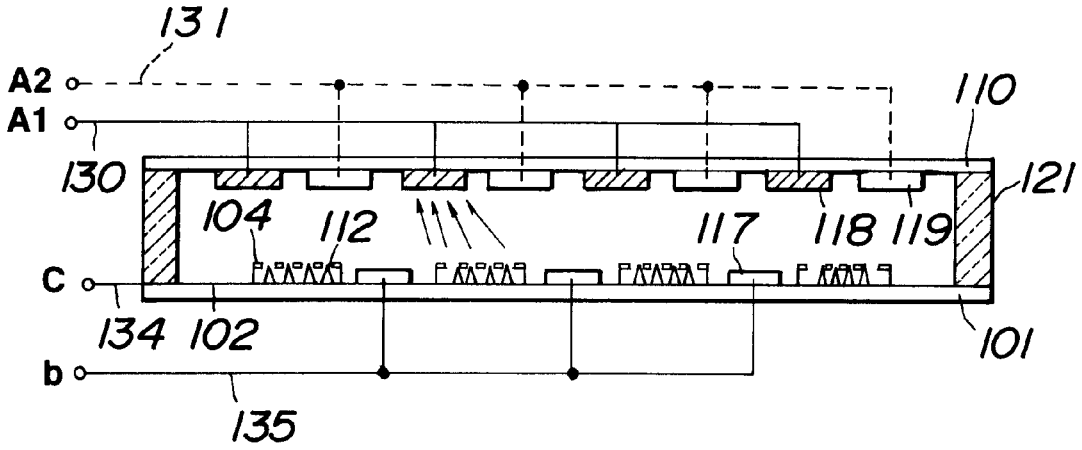
FIG. 21(*a*) is a cross-sectional view showing another example of a conventional field emission display element.
Figure 21B:
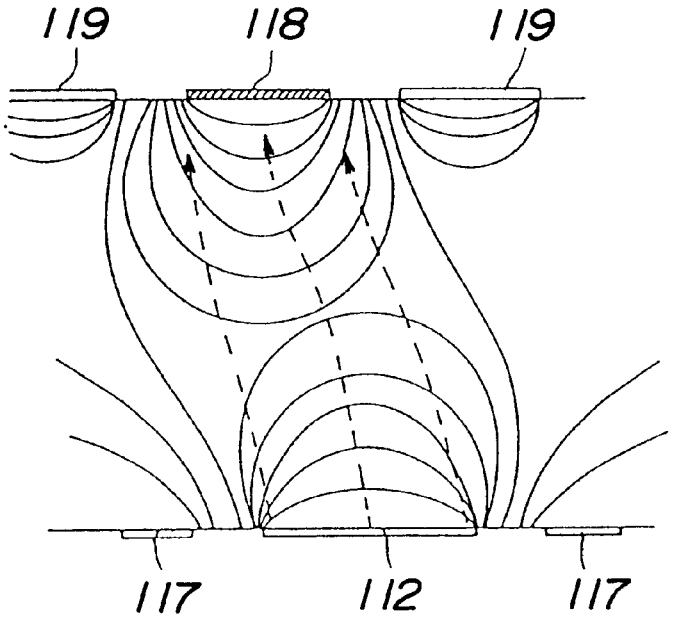
Figure 22:
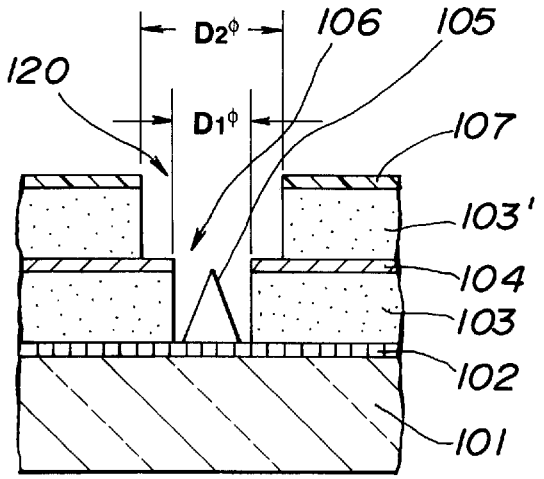
FIG. 22 is a cross-sectional view showing still another example of a conventional field emission display element.

FIG. 1 is a schematic perspective view showing a cathode substrate for a field emission display device according to the first embodiment of the present invention. FIG. 2 is an enlarged view showing part of the cathode substrate. FIG. 3 is a cross sectional view showing part of the cathode substrate of FIG. 2. Referring to FIG. 1, numeral 1 represents a cathode substrate. Numeral 7 represents a second gate electrode (focusing electrode). Numeral 20 represents an opening formed in the second gate electrode 7. Numeral 30 (hatched portion) represents an emitter area (emitter array) corresponding to one pixel. Like the structure shown in FIG. 21, cathode electrodes on which emitters are formed, insulating layer on the portion in which emitters on the cathode electrode are not formed, first gate electrodes formed on the insulating layer, and second insulating layer formed on the first gate electrodes are formed on the cathode substrate 1. These elements are not depicted in FIG. 1. The second gate electrode 7 is formed on the second insulating layer. Two lines of round openings 20, for example, are arranged in the emitter array area corresponding to one pixel. An emitter is placed in the insulating layer 3 under one opening 20.

FIG. 2 shows an enlarged emitter array 30 corresponding to one pixel. As shown in FIG. 2, two lines of openings 20 are arranged in the second gate electrode (focusing electrode) 7. An opening 6 is formed in the first gate electrode (lead-out electrode) 4 under the opening 20. An emitter 5 is placed in the opening formed by removing the insulating layer 3 beneath the opening 6. The horizontal distance P1 between emitters 5 is 3 μm to 20 μm. The vertical distance P2 between emitters 5 is 3 μm to 20 μm.

FIG. 3 is a cross-sectional view partially showing a field emission display device according to the first embodiment of the present invention. As described above, numeral 1 represents a cathode substrate such as glass. Numeral 2 represents a stripe-like cathode electrode of a metal such as aluminum formed on the cathode substrate 1. Numeral 5 represents a cone emitter of a metal such as molybdenum formed on the cathode substrate 2. Numeral 3 represents an insulating layer such as silicon dioxide ($SiO_2$) formed on portions of the cathode substrate 2 where cone emitters 5 are not formed. Numeral 4 represents a first gate electrode (lead-out electrode) formed on the insulating layer 3. Round openings 6 are formed in the first gate electrode 4. The edge of the cone emitter 5 is viewed through the opening 6. The second insulating layer 3' is further formed on the first gate electrode 4. The second gate electrode (focusing electrode) 7 is formed on the second insulating layer 3'. A round opening 20 is formed in the focusing electrode 7. The opening of the first gate electrode 4 as well as the emitter 5 placed in an opening formed by removing the insulating layer 3 are viewed through the opening 20.

An anode substrate 10 such as glass is placed over the focusing electrode 7. An anode electrode 9 is uniformly formed over the anode electrode 10. Fluorescent substance layers 8 are coated on the anode electrode 9.

Let us now explain typical dimensions of the constituent elements. The thickness L1 of the insulating layer 3 is 0.5 μm to 2 μm. The thickness L2 of the second insulating layer 3' is 0.5 μm to 2 μm.

The distance L3 between the focusing electrode 7 and the fluorescent substance layer 8 is 1 mm to 5 mm. The thickness t of the first gate electrode 4 is 0.2 μm to 0.4 μm. The thickness t of the focusing electrode 7 is 0.2 μm to 0.4 μm. The diameter of the round opening 6 formed in the first gate electrode 4 is 1 μm to 2 μm. The shortest distance d1 between the edge of the opening 20 formed in the focusing electrode 7 and the center of the emitter 5 is 0.7 μm to 10 μm. The width d3 of the focusing electrode 71 formed between the openings 20 is 4 μm to 19 μm.

The anode voltage Va applied between the anode electrode 9 and the cathode electrode 2 is 2 kV to 10 kV. The first gate voltage Vg1 applied between the first gate electrode 4 and the cathode electrode 2 is 20 V to 200 V. The focusing gate voltage Vg2 applied between the second gate electrode 7 and the cathode electrode 2 is −10 V to 10 V.

The emitter array 30 for one pixel includes 120 emitters (2 rows×60) for operation on an anode voltage Va of 2 kV. The emitter array 30 for one pixel includes 80 emitters (2 rows×40) for operation on an anode voltage Va of 5 kV. As described above, since the anode voltage is high, the number of emitters corresponding to one pixel can be reduced.

Figure 5B:
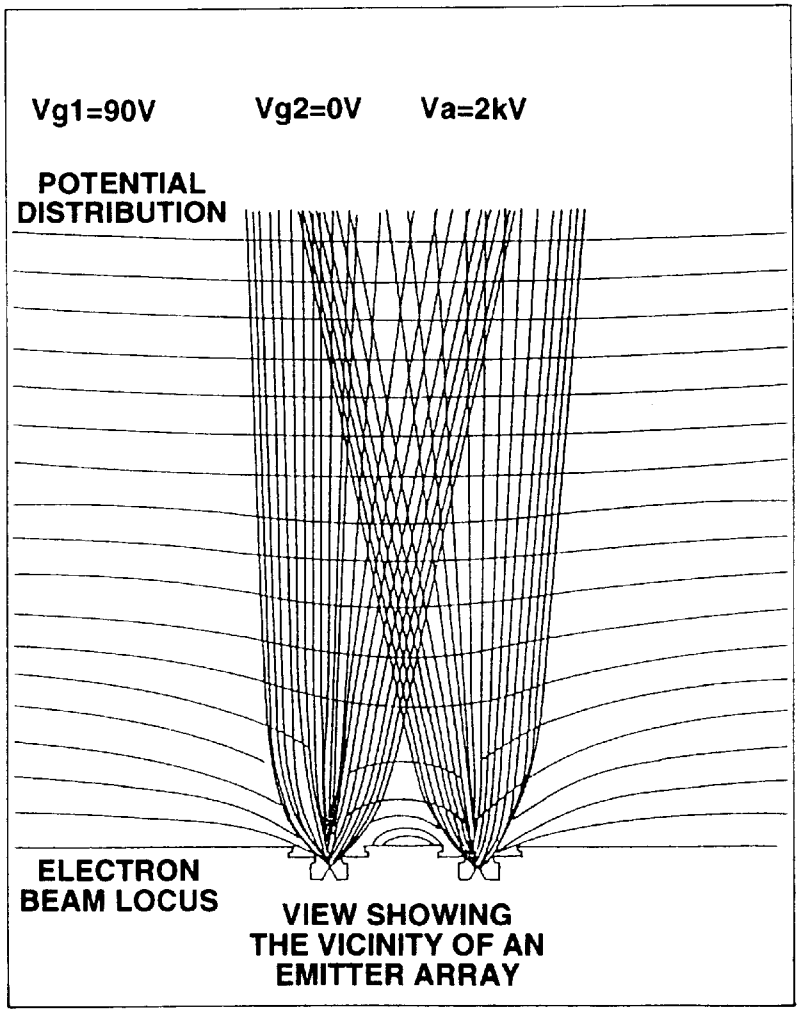
FIGS. 5(*a*) and 5(*b*) are diagrams each showing the locus of an analytically simulated electron beam in a field emission display device according to an embodiment of the present invention.
Figure 5A:
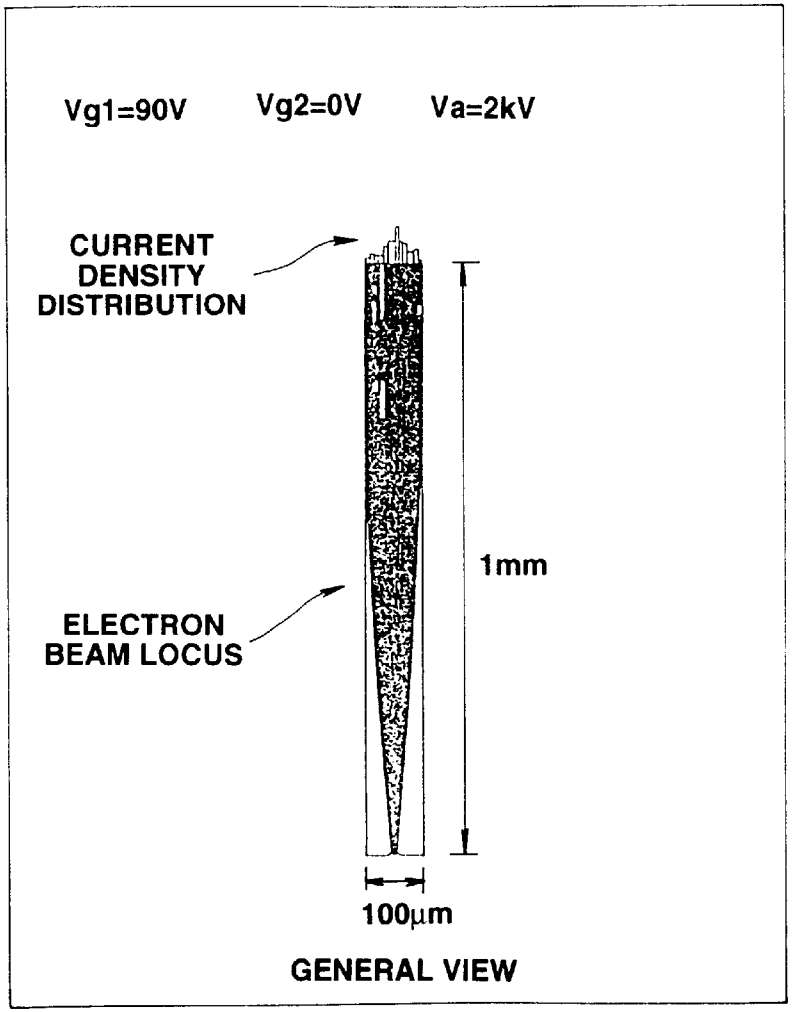

FIGS. 5(*a*) and 5(*b*) show the electric field analytical simulation results of the field emission display device with the above-described configuration. The parameters are specified such that the diameter of the opening formed in the first gate electrode 4 is 1 μm; the distance P1 between adjacent emitter rows is 10 μm; the distance P2 between adjacent emitters 5 is 5 μm; L1=1 μm; L2=1 μm; L3=1 mm; t=0.2 μm; d1=2.5 μm; d3=5 μm; Vg1=90 V; Vg2=0 V; and Va=2 kV. FIG. 5(*a*) is a general view showing the locus of an electron beam emitted from the emitter array. FIG. 5(*b*) is an enlarged view showing the loci of electron beams in the vicinity of an emitter array.

Figure 23:
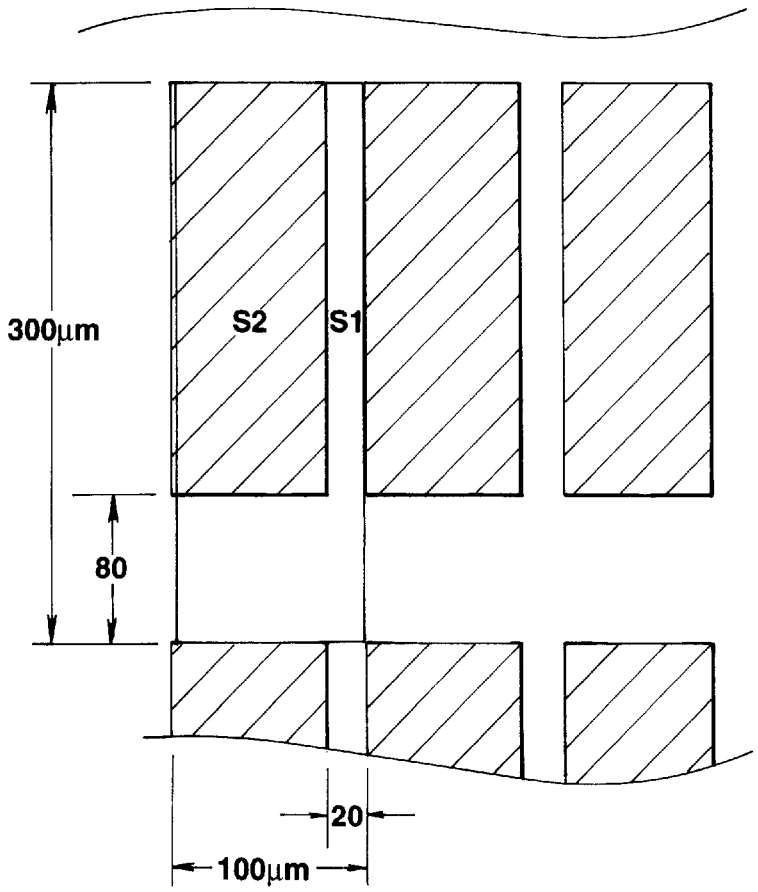
FIG. 23 is a diagram used for explaining the dot size of a fluorescent substance dot in a typical full-color display device.

As shown in FIG. 5(*b*), the emitters arranged side by side emit two electron beams directed somewhat inward. The two electron beams intersect each other and then reach the anode electrode lmm apart from each emitter. The width of one electron beam on the anode (or spot width) is about 100 μm. The width of one dot in a full-color display is about 80 μm, as described with FIG. 23. Hence, if the width of the electron beam on the anode is 80 μm to 100 μm, it can be prevented that the crossing of electron beams causes the color mixture so that the whole fluorescent substance surface can be evenly glowed. Consequently, in the example shown in FIGS. 5(*a*) and 5(*b*), it is suitable in practice that the width is 100 μm.

Figure 4A:
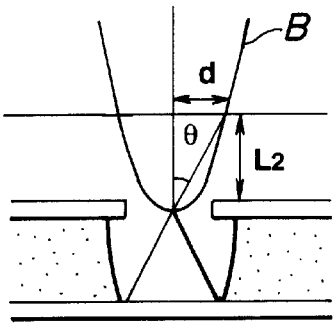
FIG. 4(*a*) is a diagram showing the locus of electron beams emitted from a field emitter in a Spindt type field emission display device.
Figure 4B:
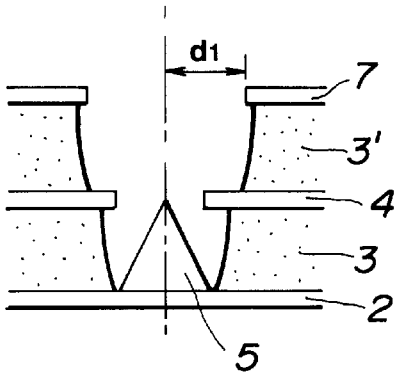
Figure 19:
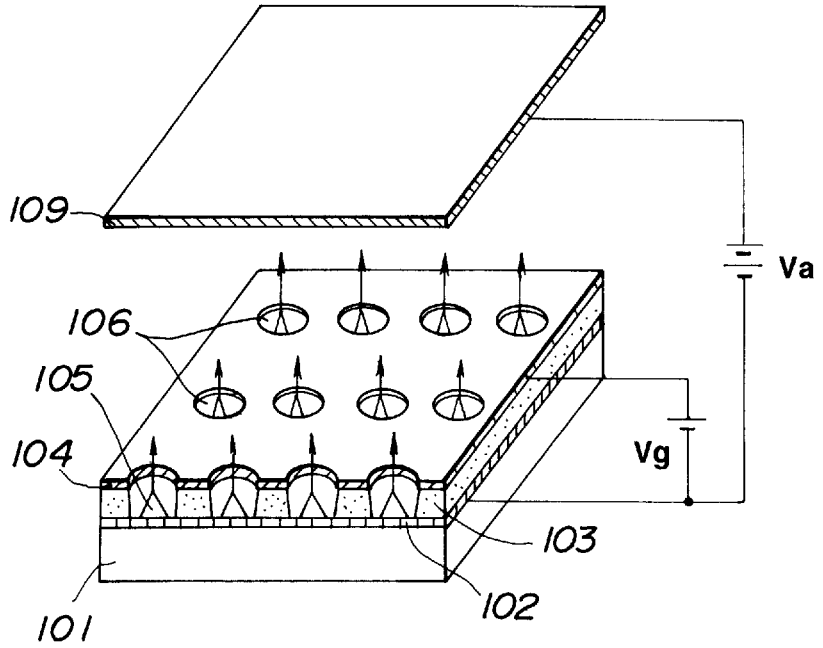
FIG. 19 is a diagram schematically showing a field emission display device including Spindt type field emission cathodes.
Figure 20:
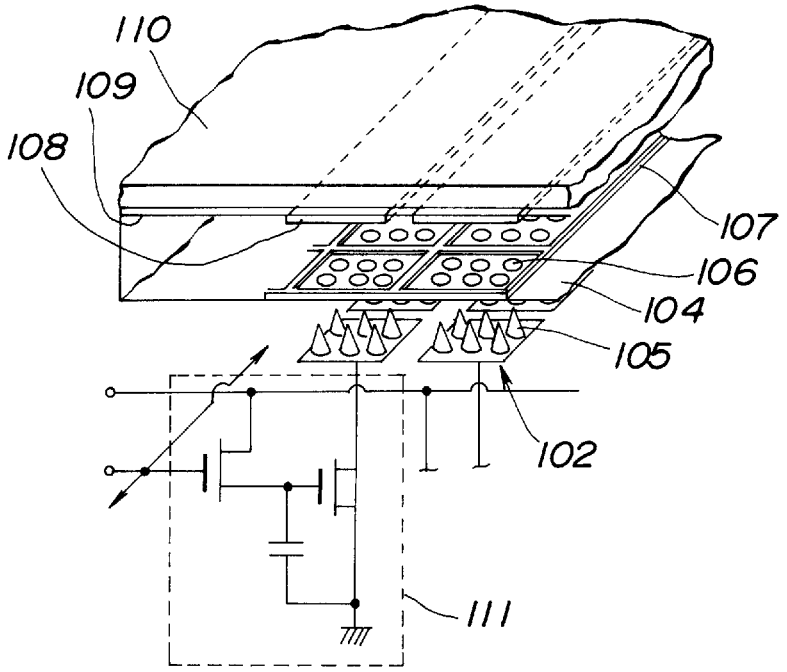
FIG. 20 is a diagram partially showing an example of a conventional field emission display device, and partially including the cross-section thereof.

Next, examination will be made on the size of an opening 20 formed in the focusing electrode 7. FIG. 4(*a*) is a diagram illustrating the locus of electrons emitted from the Spindt-type field emitter of FIG. 19. The electron beam emitted from the emitter 5 has the divergence B, as shown in FIG. 4(*a*). The expression $d=L2\times\tan\theta$ is held, where θ is an angle at which electrons from the emitter diverges upward by a distance L2, and d is a divergent width. FIG. 4(*b*) shows the cross section of a cathode according to the present invention. L2 is a distance between the focusing electrode 7 and the first gate electrode 4. d1 is the shortest distance between the center of the emitter 5 and the edge of the opening in the focusing electrode 7.

Figure 6A:
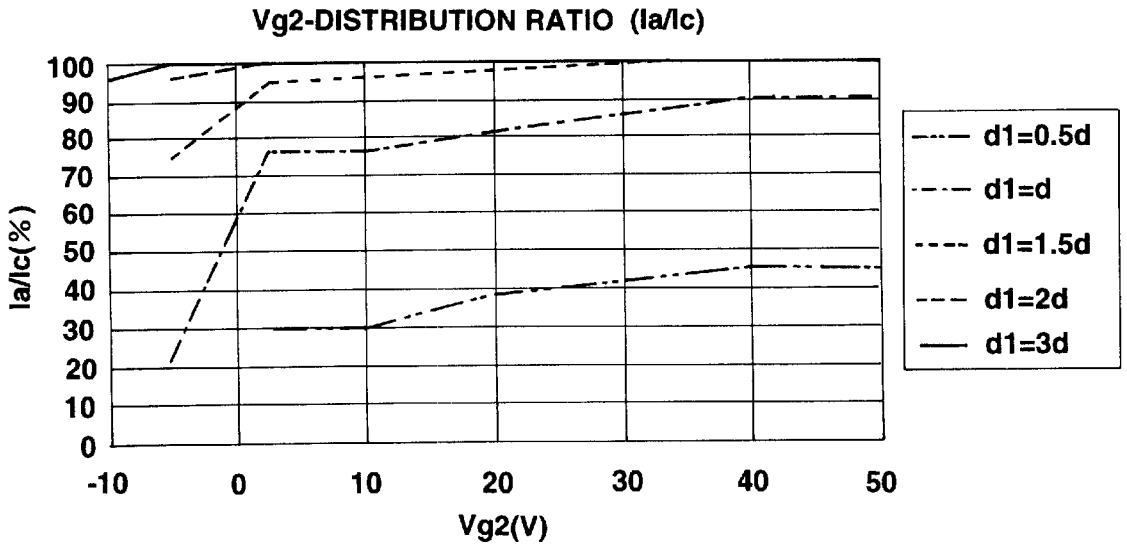
FIG. 6(*a*) is a graph showing relations between second gate voltage and distribution ratio (Ia/Ic), plotted for ratio of the radius of an opening in a focusing electrode to divergent width as parameter.
Figure 6B:
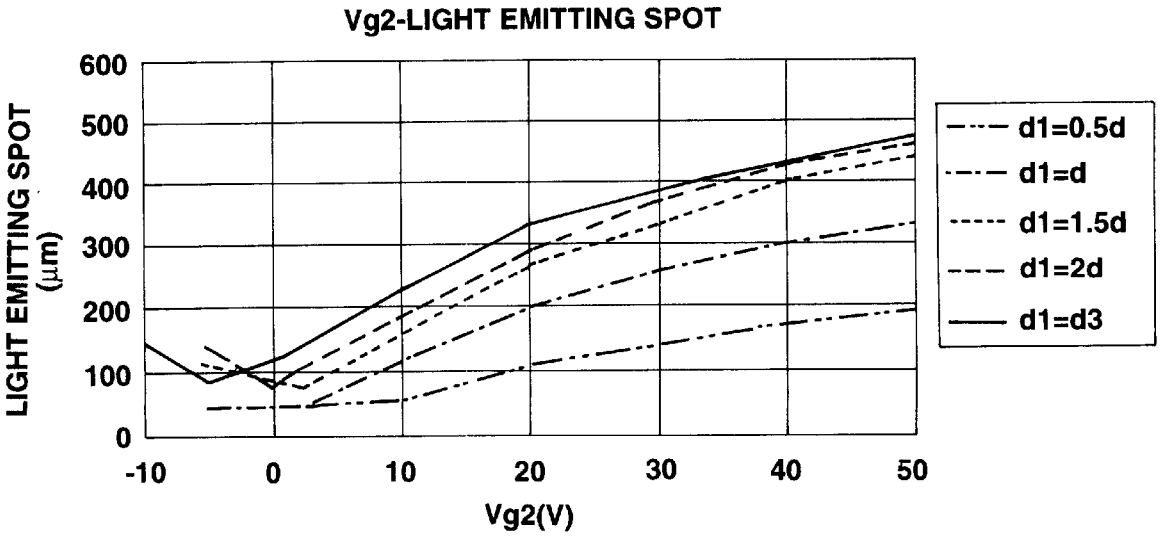

FIG. 6(*a*) shows the relations between second gate voltage Vg and distribution ratio, plotted for ratio of a radius d1 of the opening 20 in the focusing electrode 7 to a divergent width d as parameter. FIG. 6(*b*) shows the relations between second gate voltage Vg and luminous spot size, plotted for ratio of a radius d1 of the opening 20 in the focusing electrode 7 to a divergent width d as parameter. The distribution ratio (Ia/Ic) is a ratio of electrons reaching the anode to electrons emitted from the cathode. The distribution ratio close to 100% indicates less ineffective current flowing into the first and second gate electrodes. In FIG. 6(*a*), distribution ratios are plotted with respect to the second gate (focusing electrode) voltage Vg2 on abscissa when the parameter d1 are 0.5 d, d, 1.5 d, 2 d, and 3 d. In FIG. 6(*b*), distribution ratios are plotted with respect to luminous spot size when the parameter d1 are 0.5 d, d, 1.5 d, 2 d, and 3 d. As understood from FIGS. 6(*a*) and 6(*b*), when the size d1 of the opening in the focusing electrode 7 is selected to satisfy the expression $d \leqq d1 \leqq 3.0\,d$, the distribution ratio (Ia/Ic) is maintained high at a second gate voltage Vg2 suitably selected, so that the luminous spot can be focused to have a desire diameter of about 100 μm.

Figure 7A:
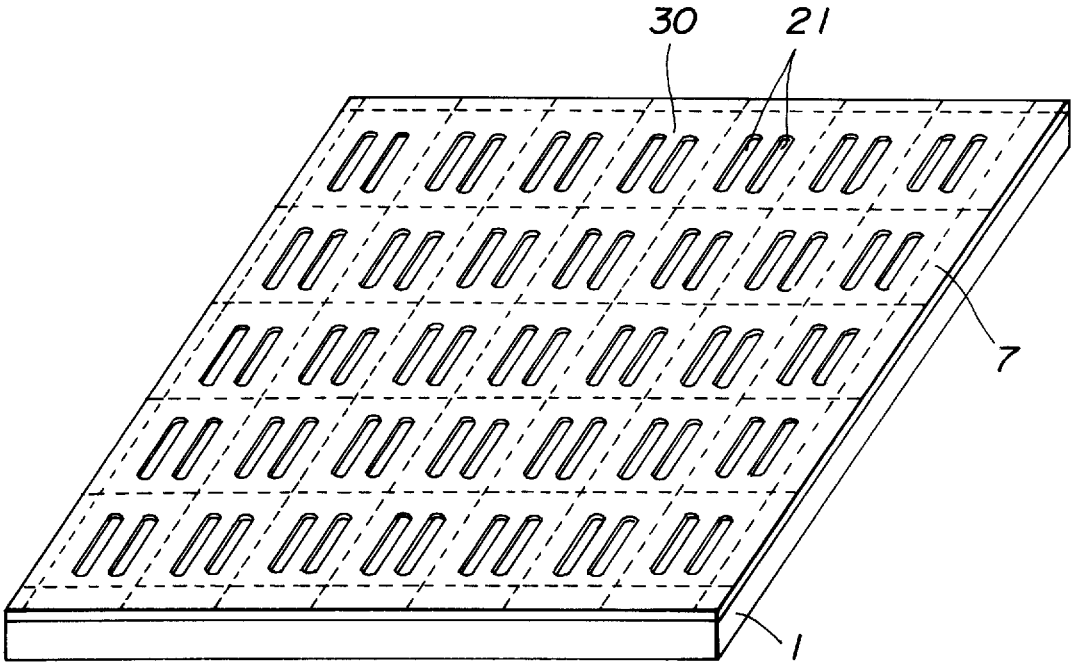
FIG. 7(*a*) is a perspective view showing the cathode substrate used in a field emission display device, according to a second embodiment of the present invention.
Figure 7B:
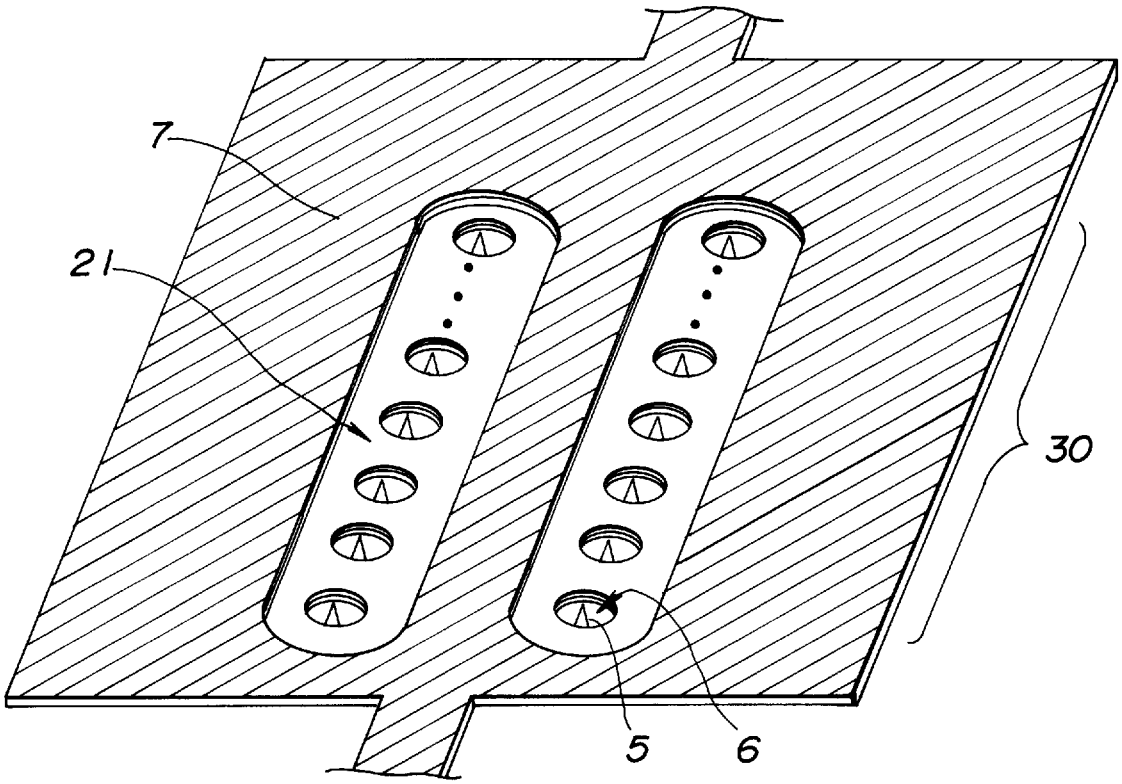

Next, the second embodiment of the field emission display device according to the present invention will be described below. FIG. 7(*a*) is a perspective view schematically illustrating a cathode substrate in the second embodiment. FIG. 7(*b*) is an enlarged view partially illustrating an emitter array in the cathode substrate. As understood from the figures, the second gate electrode has slit-like openings 21. A line of openings 6 formed in the first gate electrode 4 are arranged under each slit-like opening 21. A line of emitters 5 are arranged under each opening 6. Two slit-like openings 21 are prepared for one pixel.

The horizontal cross-section of the cathode substrate according to the embodiment shown in FIG. 7 is identical to that in FIG. 3. Hence, electrons emitted from the emitter 5 to the anode has the locus identical to that shown in FIG. 5.

Figure 8A:
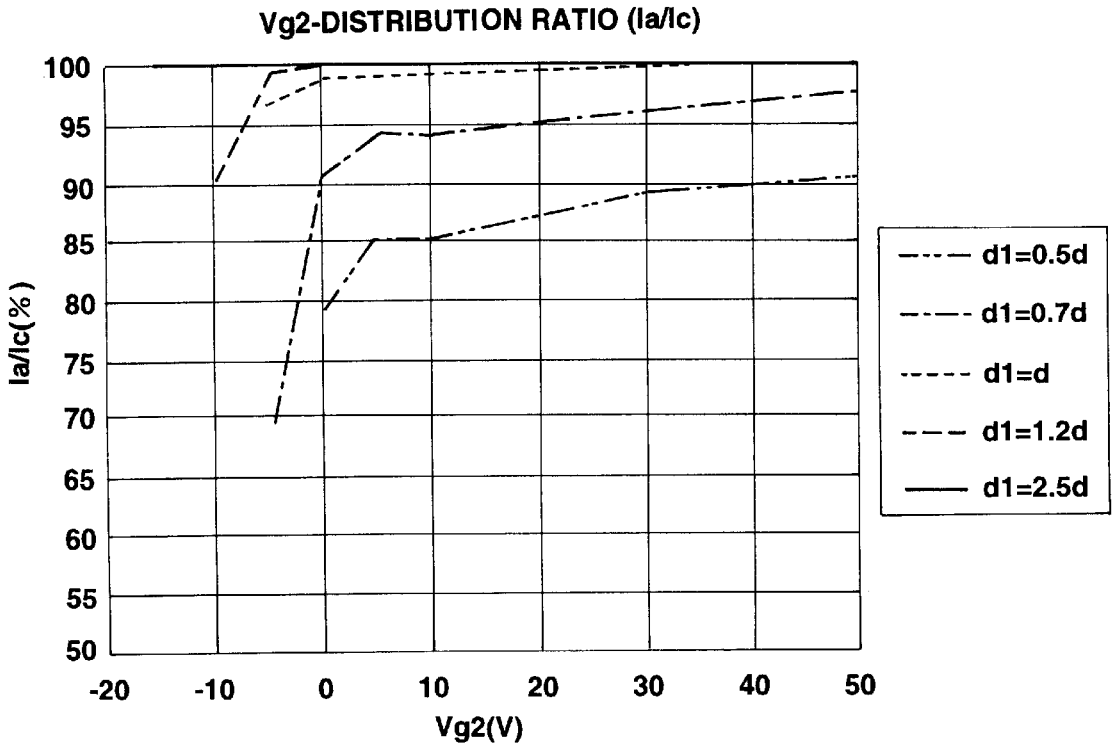
FIG. 8(*a*) is a graph showing relations between second gate voltage and distribution ratio (Ia/Ic), plotted for ratio of radius of an opening in a focusing electrode to divergent width as parameter, in a field emission display device according to the second embodiment of the present invention.
Figure 8B:
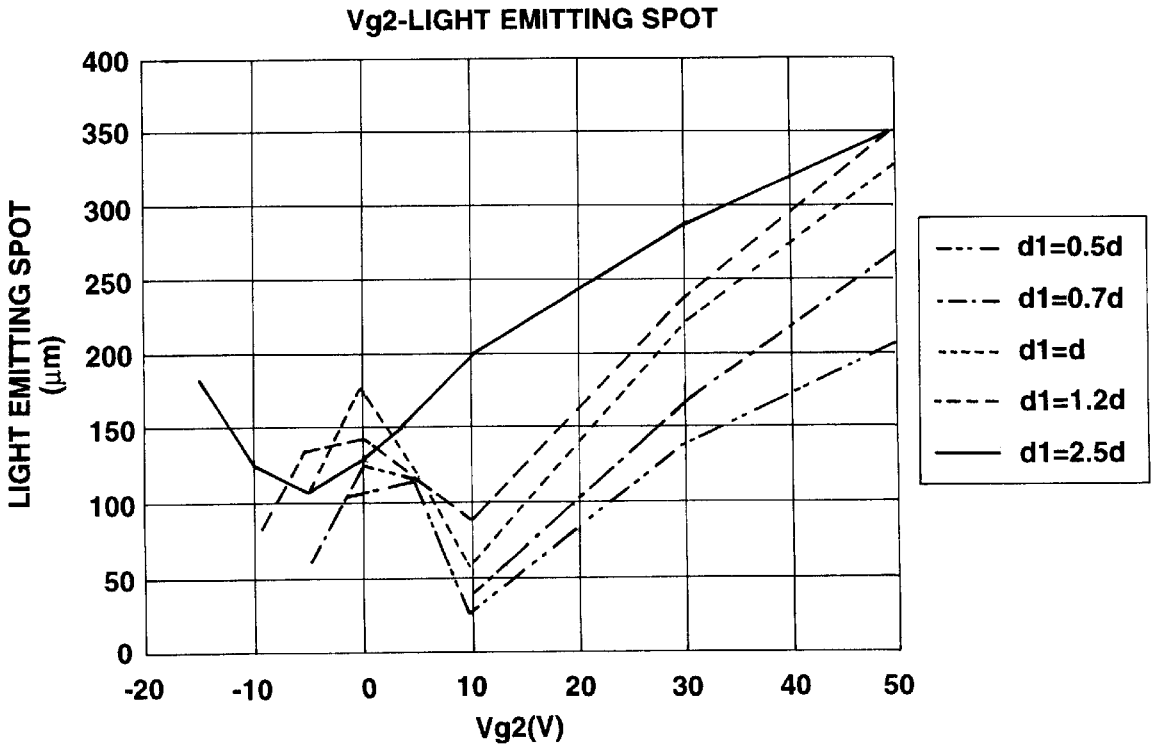

In the second embodiment, FIG. 8(*a*) shows the relations between second gate voltage Vg and distribution ratio, plotted for the shortest distance d1 between the emitter 5 and the edge of the slit-like opening 21 as parameter. FIG. 8(*b*) shows the relations between second gate voltage Vg and luminous spot size, plotted for the shortest distance d1 between the emitter 5 and the edge of the slit-like opening 21 as parameter. In FIG. 8(*a*), distribution ratios are plotted with respect to the second gate (focusing electrode) voltage Vg2 on abscissa when the parameter d1 are 0.5 d, 0.7 d, d, 1.2 d, and 2.5 d. In FIG. 8(*b*), luminous spots are plotted with respect to second gate voltage Vg2 when the parameter d1 are 0.5 d, 0.7 d, d, 1.2 d, and 2.5 d. As understood from FIGS. 8(*a*) and 8(*b*), when the size d1 of the opening 7 in the focusing electrode 7 is selected to satisfy the expression $0.5\ d \leqq d1 \leqq 2.5\ d$, the distribution ratio (Ia/Ic) is maintained to about 100% at a second gate voltage Vg2 suitably selected, so that the electrons reaching the anode can be focused to have a desired beam width of about 100 μm.

In the two embodiments as described above, a luminous spot of about 100 μm can be formed on the anode. However, when electrons impinges onto the fluorescent substance layer of the size shown in FIG. 23, it is desirable to focus the luminous spot to about 80 μm.

As described above, the electron locus analysis diagram shown in FIG. 5(*b*) shows that two electron beams emitted from two emitters arranged side by side travel somewhat inward and cross each other. That is, the locus of the electron beam emitted from the left emitter deflects slightly clockwise while the locus of the electron beam emitted from the right emitter deflects slightly counterclockwise. The reason is considered that the focusing effect of the focusing electrode 71 between the openings 20 or 21 is weaker than that of the focusing electrode 7 because the focusing electrode 71 is narrower than the right and left focusing electrodes 7. Hence, two electron beams emitted from the emitters can be traveled straight and upward by equalizing the focusing effect of the focusing electrode 71 with that of the focusing electrodes 7, so that the focusing degree can be more improved.

Figure 9A:
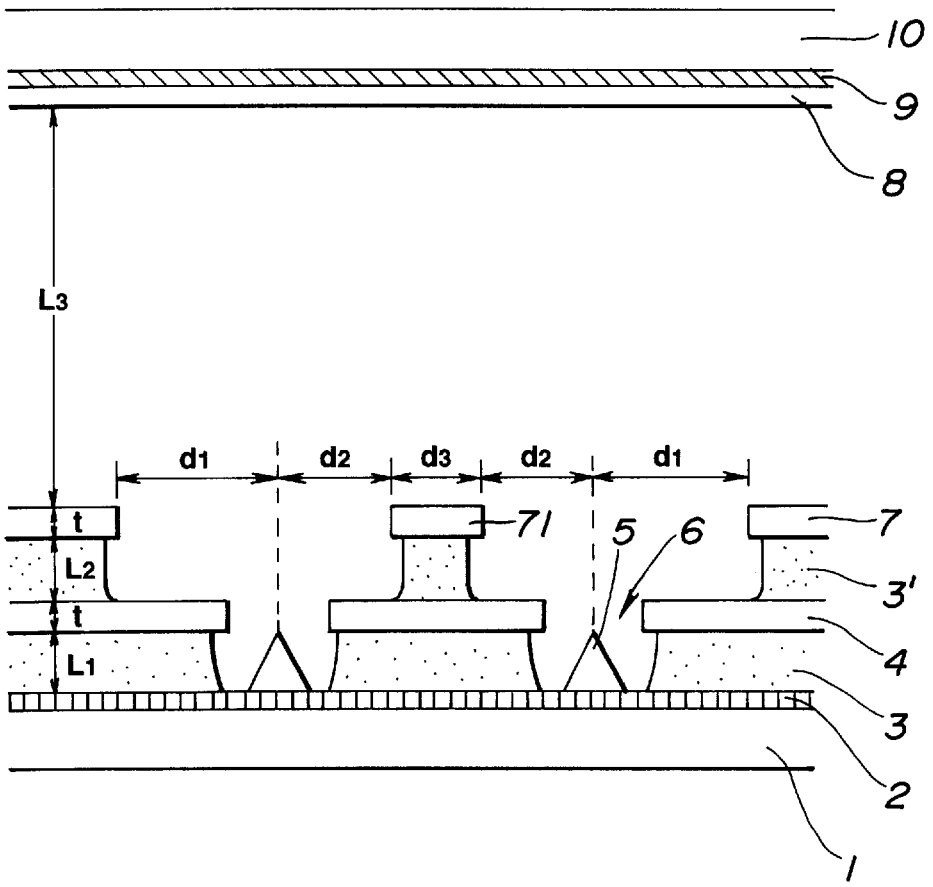
FIG. 9(*a*) is a side cross-sectional view partially showing a field emission display device according a third embodiment of the present invention.
Figure 9B:
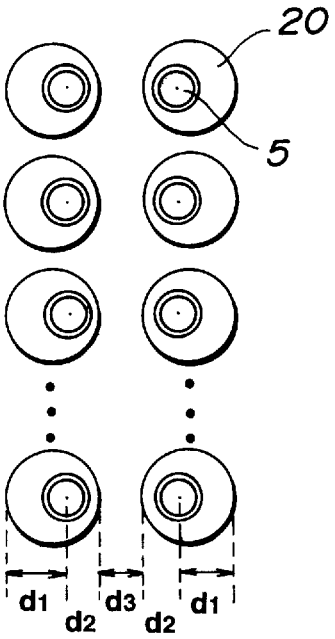
Figure 9C:
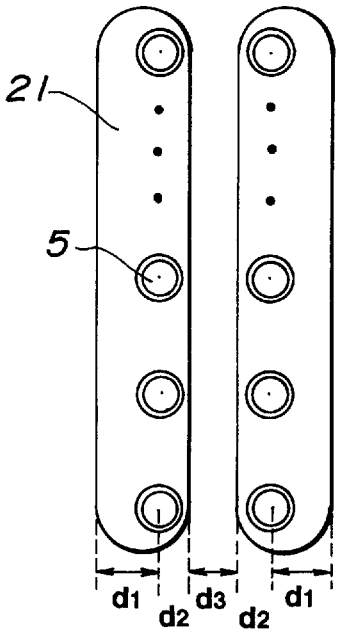

Next, the field emission display device with improved focusing degree according to the third embodiment of the present invention will be explained below. FIG. 9(*a*) is a cross-sectional view partially illustrating the field emission display device. In the figure, like numerals represent the same constituent elements as those shown in FIG. 3. Hence duplicate explanation will be omitted here.

In this embodiment, the distance d2 between the edge of the emitter 5 and the focusing electrode 71 placed between the emitters is shorter than the distance d2 between the edge of the emitter 5 and the focusing emitter 7 ($d2<d1$). This configuration can equalize the above-mentioned focusing effects because of the short distance between the focusing electrode 71 with a small area and the emitter and the effective focusing effect of the focusing electrode 7.

FIG. 9(*b*) is a plan view illustrating an emitter array structure with two lines of plural openings 20 shown in FIG. 2, according to the third embodiment. As seen from FIG. 9(*b*), the emitters of the left line is shifted to the right side from the center of the opening 20 while the emitters of the right line is shifted to the left side from the center of the opening 20.

FIG. 9(*c*) is a plan view illustrating an emitter array structure with slit-like openings 21 in which emitters 5 are arranged as shown in FIG. 7, according to the third embodiment. In this case, the emitters in each slit-like opening 21 are arranged close to the intermediate portion sandwiched between two slit-like openings 21.

Figure 10B:
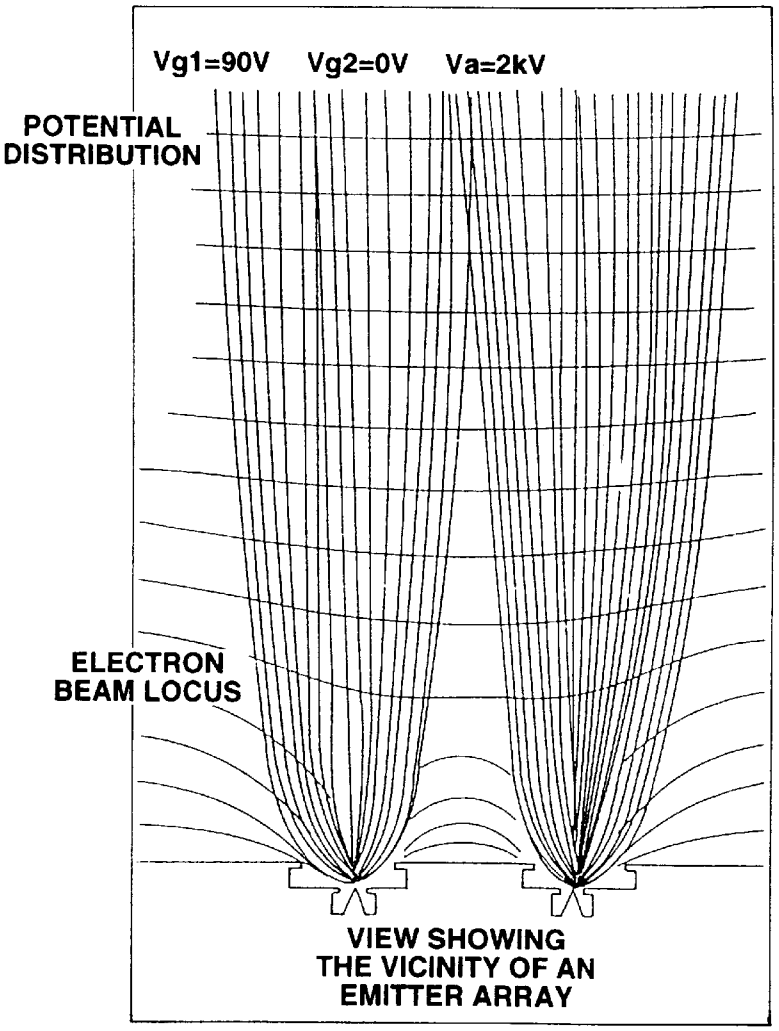
FIGS. 10(*a*) and 10(*b*) are diagrams showing the locus of an analytically simulated electron beam in a field emission display device according to the third embodiment of the present invention.
Figure 10A:
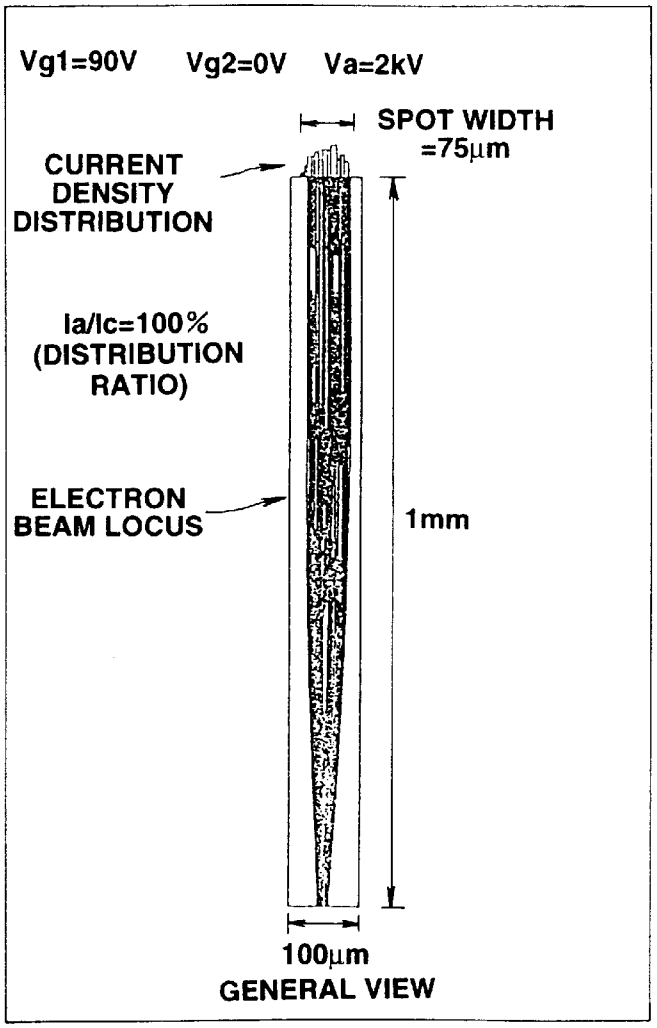

FIG. 10 shows an electron beam locus analysis diagram for a field emission display device with above-mentioned structure. Unlike FIG. 5, electron beams emitted from two emitters arranged side by side travel nearly straight without crossing each other. This cathode structure can provide a luminous spot of 75 μm, thus showing a higher focusing degree than that in the first embodiment.

Figure 11:
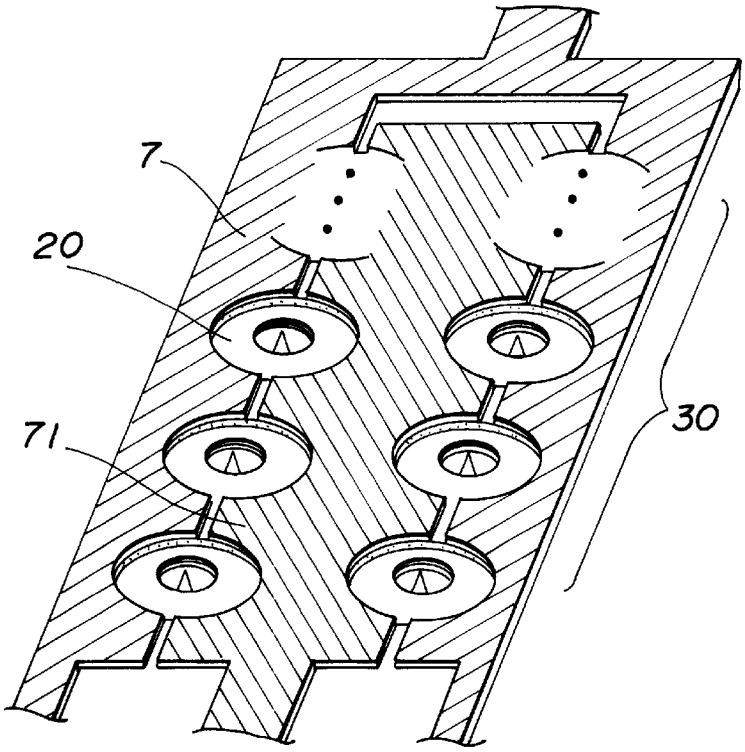
FIG. 11 is a perspective view showing the configuration of a field emission cathode in a field emission display device according to the third embodiment of the present invention.

Explanation will be made below further another embodiment having an improved focusing degree. FIG. 11 is a perspective view illustrating an emitter array structure for one pixel, according to this embodiment. Referring to FIG. 11, the second gate electrode 7 has round openings 20 arranged in two lines, like the first embodiment shown in FIG. 2. However, this structure differs from the first embodiment in that the second gate electrode (focusing electrode) is formed of two split pieces including a peripheral portion 7 and an intermediate portion 71 to define the opening portions 20.

The emitter array structure in this embodiment has the same cross section as that shown in FIG. 3. Two different second gate voltages can be respectively applied to the intermediate portion 71 and the peripheral portion 7 of the focusing electrode. When a lower gate voltage Vg3 than that of peripheral focusing electrode 7 is applied to the intermediate focusing electrode 71, the focusing effect of the intermediate focusing electrode 71 can be strengthened. Hence, like the embodiment shown in FIG. 9, electrons emitted from each emitter can be focused.

Figure 12:
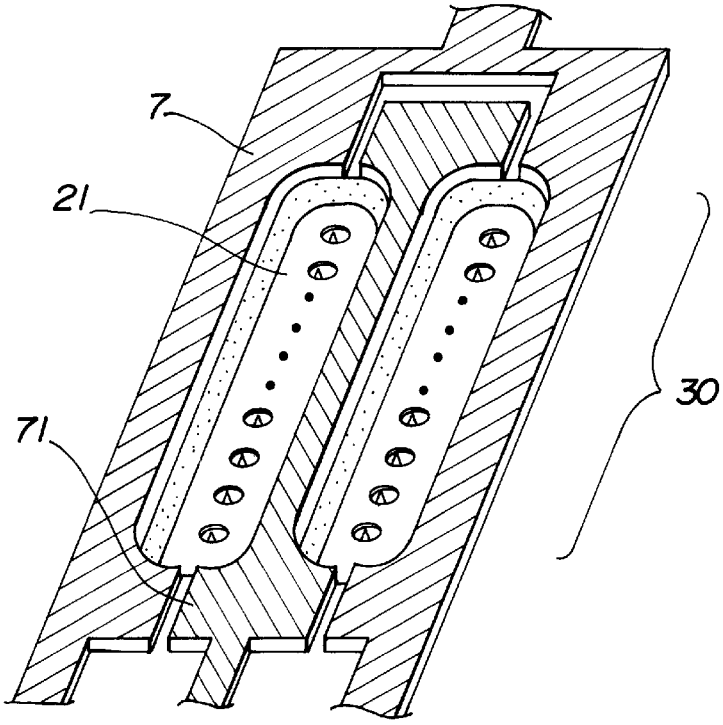
FIG. 12 is a perspective view showing the configuration of a field emission cathode in a field emission display device according to the third embodiment of the present invention.

FIG. 12 is a perspective view illustrating the emitter array structure with slit-like openings 21 shown in FIG. 7, according to the above-mentioned embodiment. As understood from FIG. 12, the focusing electrode is divided into an intermediate piece 71 and peripheral piece 7. The gate voltage Vg3 applied to the intermediate piece 71 is lower than the gate voltage Vg2 applied to the peripheral piece 7.

Figure 13B:
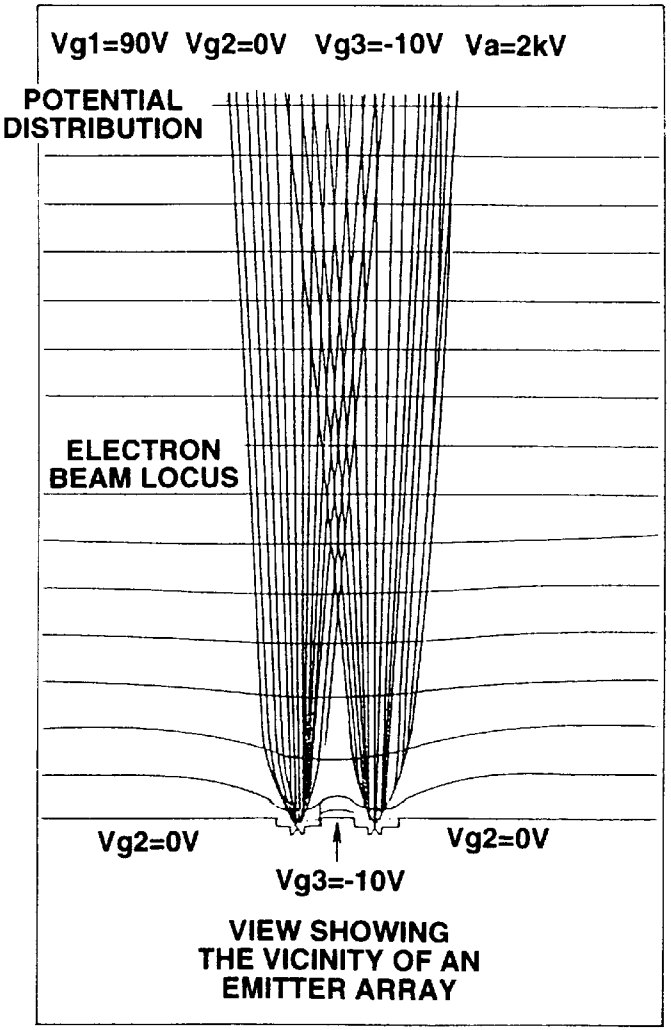
FIG. 13 is a diagram showing the locus of an analytically simulated electron beam in a field emission display device according to the third embodiment of the present invention.
Figure 13A:
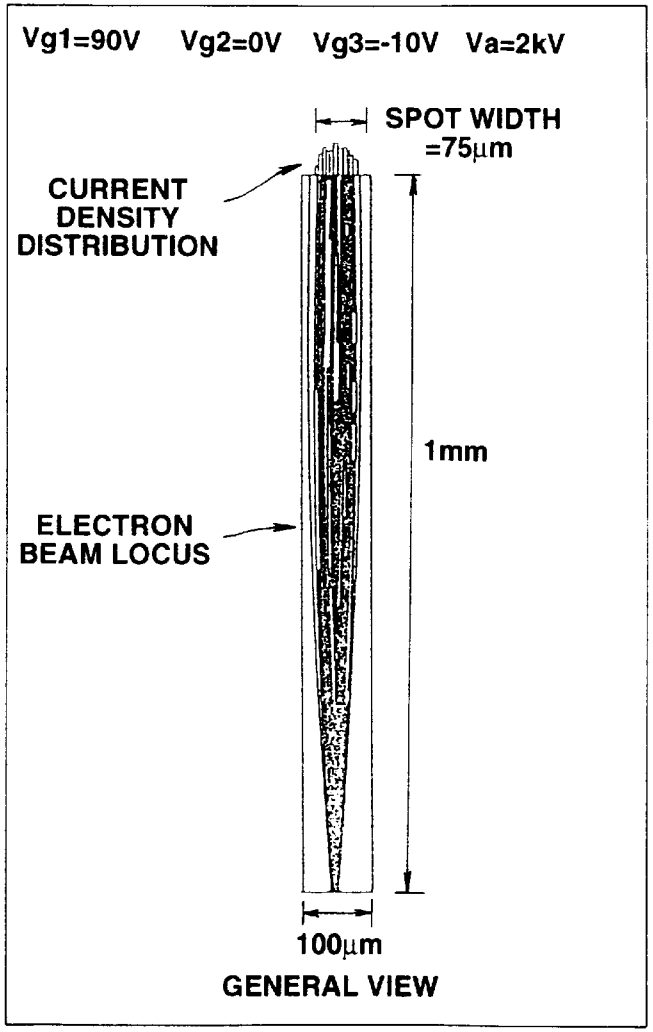

FIG. 13 shows electron beam locus analysis diagram in the above-mentioned split-type focusing electrode structure. In the electron beam loci shown in FIG. 13, the gate voltage Vg2 applied to the peripheral piece 7 is 0 volts and the gate voltage Vg3 applied to the intermediate piece 71 is −10 volts. The first gate voltage Vg1 is 0 volts and the anode voltage Va is 2 kV. As shown in FIG. 13, two emitters arranged side by side travel nearly straight and upward without crossing each other. The spot width is 75 μm on the anode 1 mm apart from each emitter. This emitter array structure can provide an excellent focusing effect.

As described above, the beam width on the anode, or the luminous spot width, can be controlled by adjusting the gate voltage Vg3 applied to the intermediate piece 71.

Figure 18A:
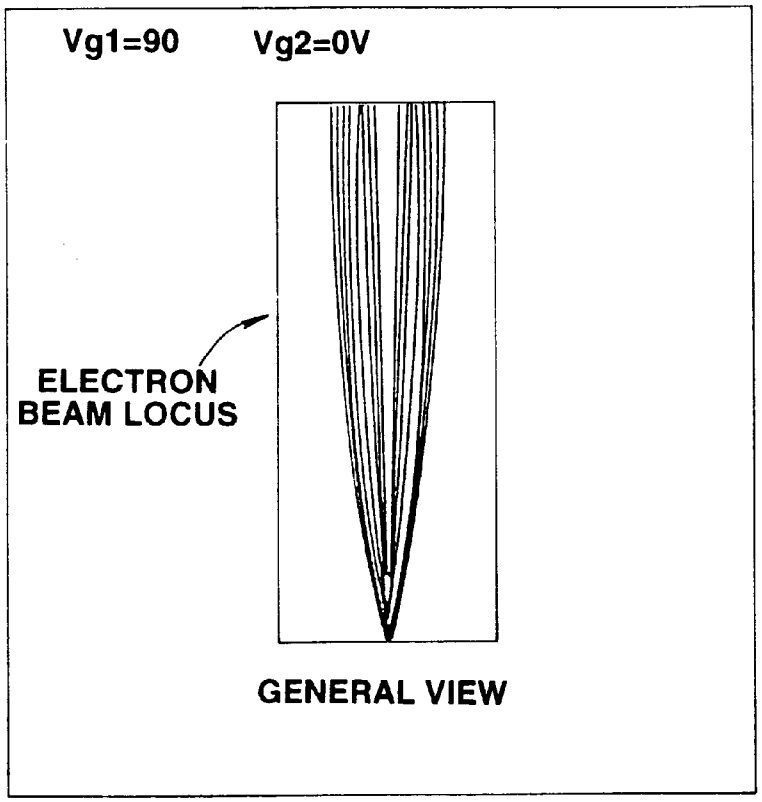
FIG. 18 is an explanatory view showing an electron beam locus in the case where only one focusing electrode is placed in the front of two rows of emitter electrodes.
Figure 18B:
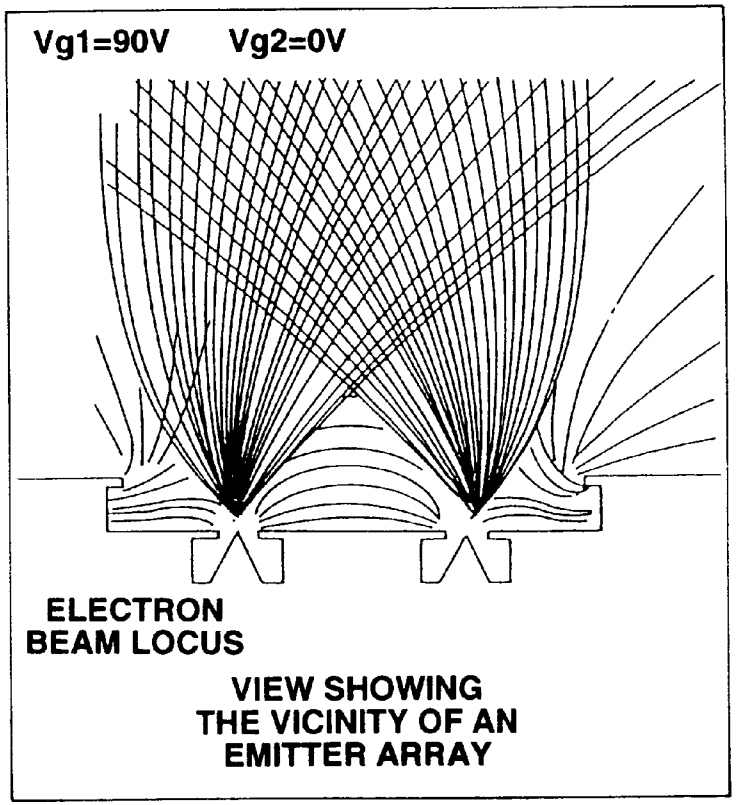

With plural lines of emitters arranged in one opening 20, or the focusing electrode prepared in common for plural lines of emitters, the focusing effect acts on electrons emitted from a line of emitters adjacent to the focusing electrode, but the diverging effect acts on electrons emitted from a line of emitters on the opposite side of the focusing electrode. The focusing effect does not sufficiently act on the electron beams emitted from emitters other than the adjacent emitters. Hence, it is not preferable to arrange plural emitter lines in one opening. FIG. 18 shows the electron beam locus analysis diagram for the structure in which emitters are arranged in two lines in the opening 20. As understood from this figure, the electron beams emitted from two lines of emitters cannot be sufficiently focused.

It has been explained that electrons diverge in the direction (the horizontal direction in figures) of the shorter side of each of the openings 20 or 21 formed in two lines. Now, the divergence of electrons in the longitudinal direction of a line of round openings 20, or the divergence of electrons in the direction of the longer side of the slit-like opening 21 will be examined below.

Figure 14A:
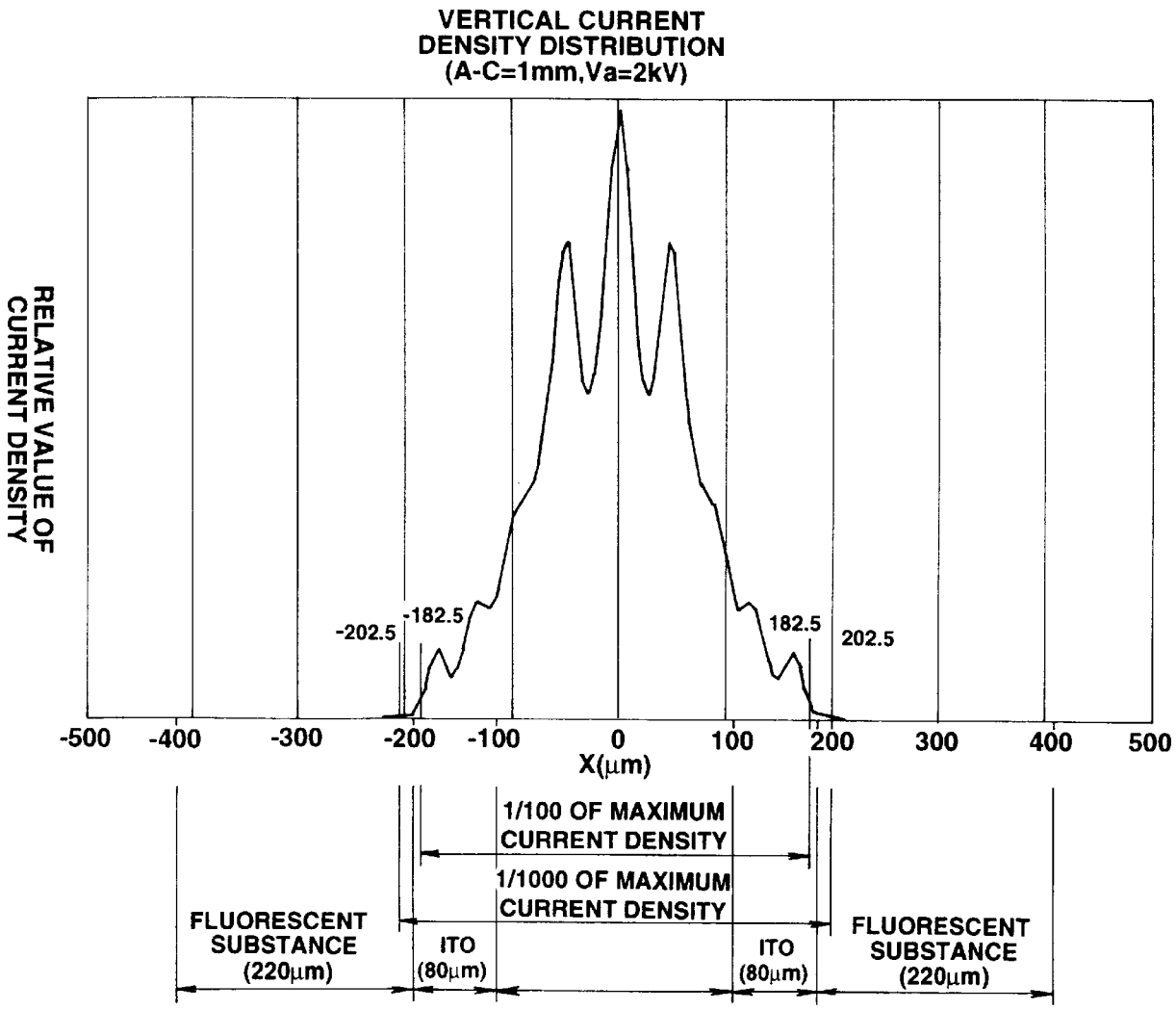
FIGS. 14(*a*) and 14(*b*) are diagrams each showing an analytical result of a vertical current density distribution in a field emission display device in an embodiment of the present invention.
Figure 14B:
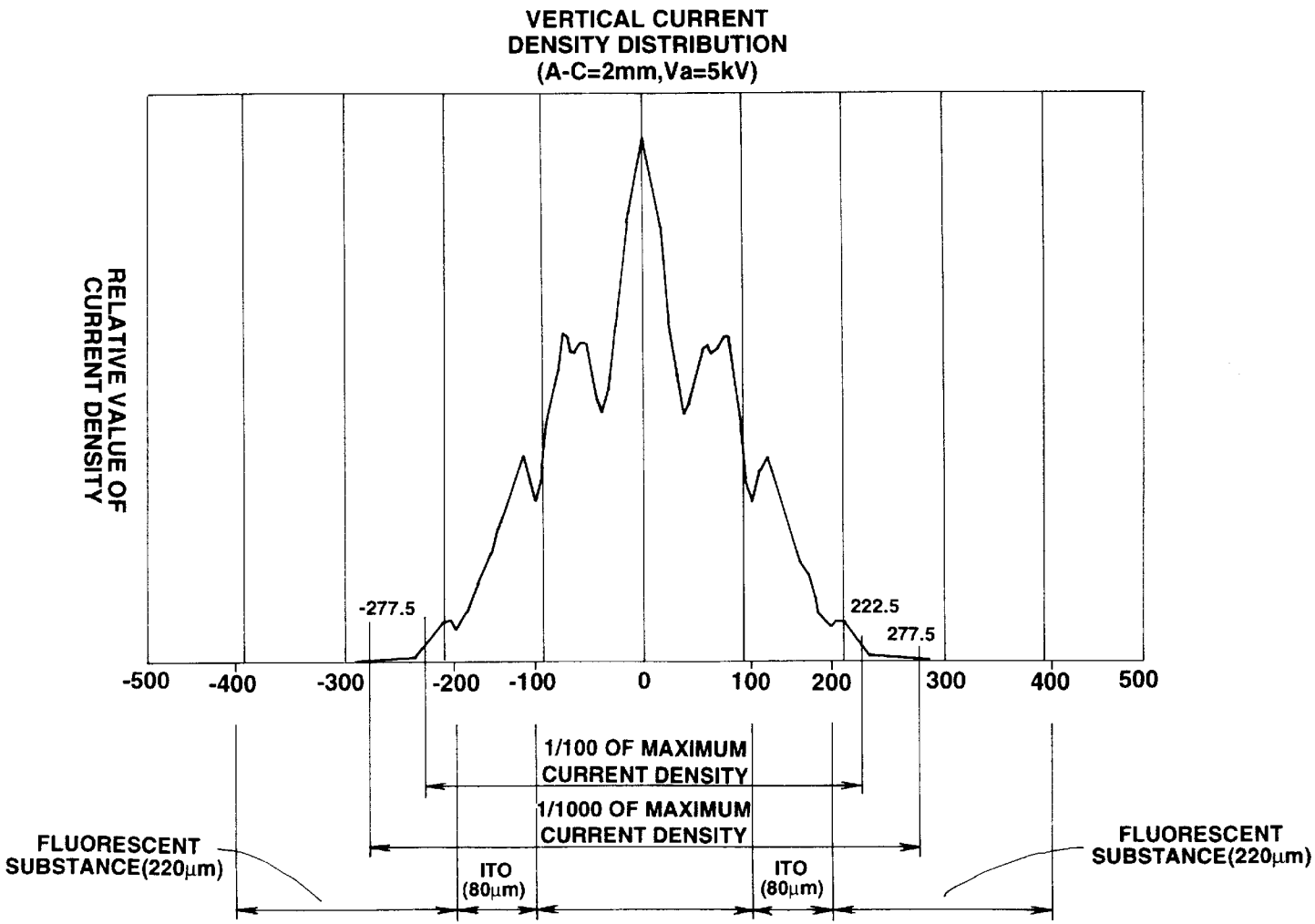

FIG. 14 shows an example of results of current density distribution analysis in the longitudinal direction of the slit-like opening. FIG. 14(*a*) shows a result analyzed under condition that the anode-to-cathode distance L3 is 1 mm and the anode voltage Va is 2 kV. FIG. 14(*b*) shows a result analyzed under condition that the anode-to-cathode distance L3 is 2 mm and the anode voltage Va is 5 kV. In either case, the electron beam width is necessarily and sufficiently within 220 5 m which is the vertical length of each fluorescent substance dot in the typical full-color display shown FIG. 17. As understood from the characteristics, a leakage of light glowed by an adjacent fluorescent substance dot is at a sufficient low level.

Figure 15B:
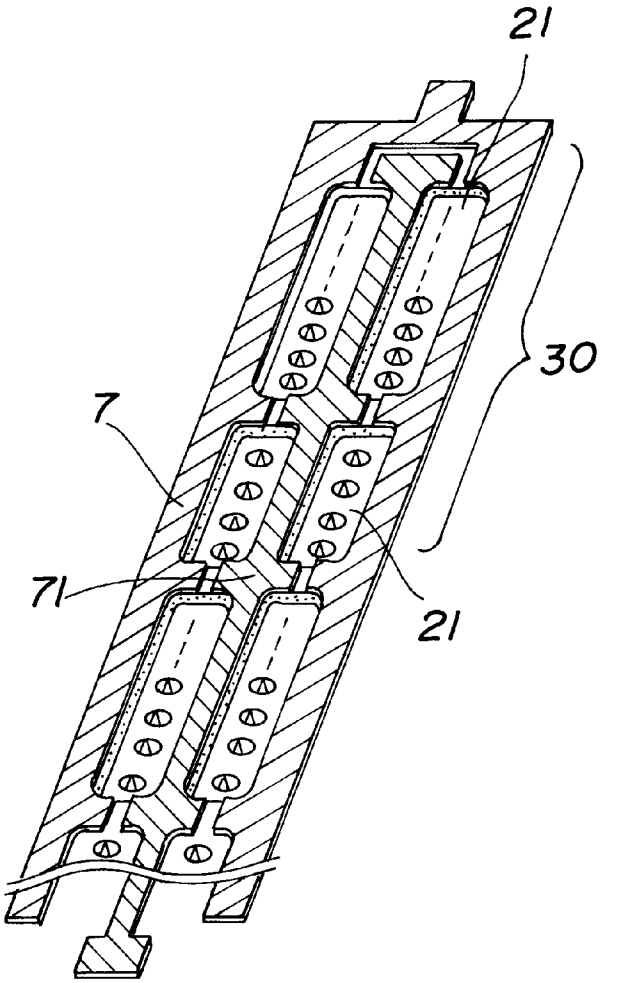
FIGS. 15(*a*) and 15(*b*) are perspective views each showing a field emission cathode structure in a field emission display device according to another embodiment of the present invention.
Figure 15A:
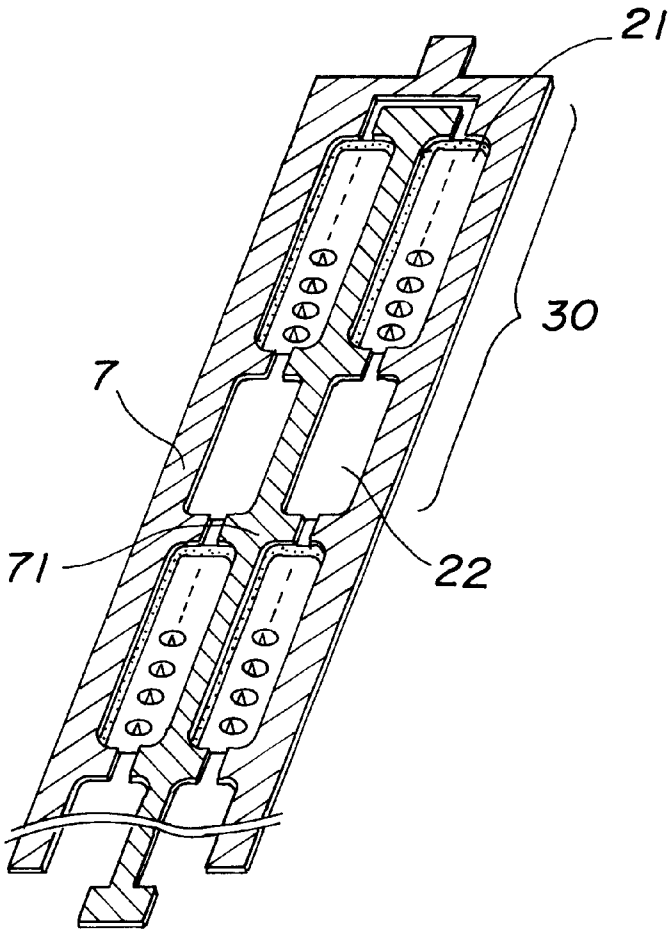

The vertical divergence of an electron beam can be precisely controlled by changing the configuration of the opening. FIGS. 15(*a*) and 15(*b*) are perspective views each illustrating an emitter array structure that the divergence of an electron beam in the vertical direction can precisely controlled, according to the present embodiment. FIG. 15(*a*) is a view showing an example of an emitter array structure which has slit-like openings 21 each divided in plural subslits. No emitters are not arranged in a subslit 22. In such an emitter arrangement, emitters can be arranged at the positions corresponding to fluorescent substance dots. FIG. 15(*b*) shows an example of an emitter array structure having slit-like openings 21 partitioned into plural subslits in which one or a suitable number of emitters are arranged. In such an arrangement, the vertical width of an electron beam can be precisely controlled on an anode electrode.

In FIG. 15, an slit-like opening 21 has been applied as an example to a focusing electrode. In a similar manner, the round openings 20 shown in FIG. 2 can be partitioned into plural openings to arrange emitters in each partitioned opening.

Figure 16A:
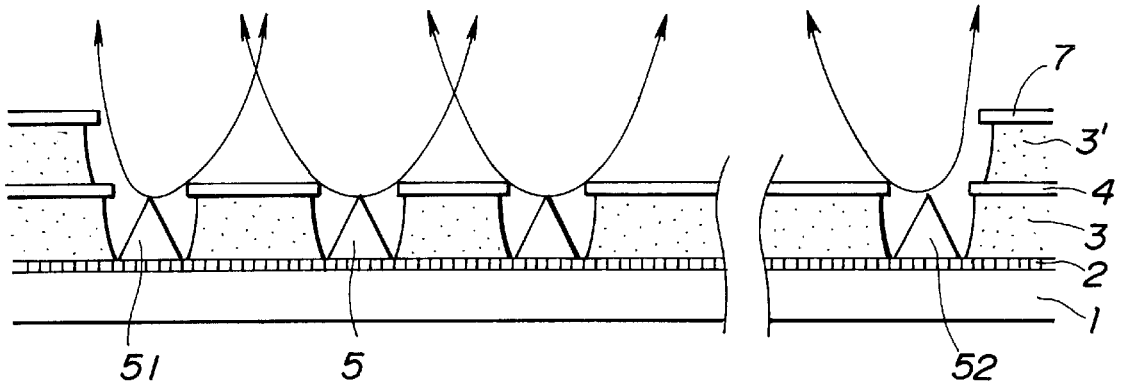
FIG. 16(*a*) is a diagram showing the configuration of a field emission cathode in which plural emitters are arranged in a slit-like opening.
Figure 16B:
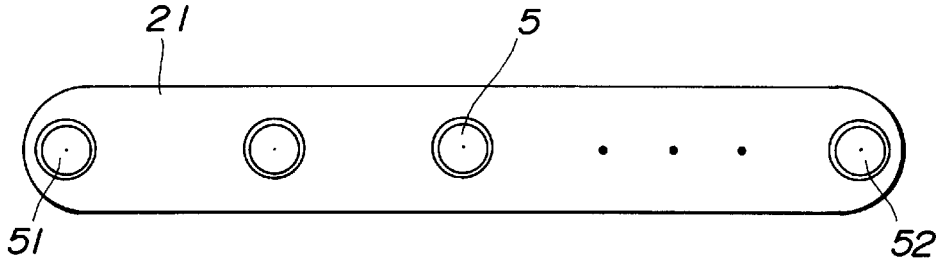
Figure 16C:
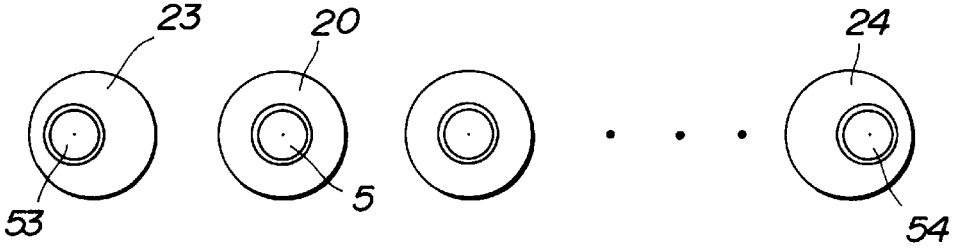

An emitter array structure according to still another embodiment that can more precisely control the vertical beam width on an anode electrode will be described below with reference to FIG. 16. FIG. 16(*a*) is a cross sectional view partially illustrating plural emitters longitudinally arranged within a slit-like opening 21. FIG. 16(*b*) is a plan view showing the plural emitters shown in FIG. 16(*a*). In this embodiment, the emitters 51 and 52 which are arranged close to the inner ends of a slit-like opening 21. In such an arrangement, as shown in FIG. 16(*a*), since the emitters 51 and 52 are arranged close to both inner ends of the slit 21 in the focusing electrode 7, the loci of electron beams emitted from the emitters 51 and 52 are affected largely. Hence, in the above-mentioned embodiment, electrons emitted from emitters arranged in the slit-like opening 21 can be more focused longitudinally on the anode electrode, in comparison with the above-mentioned embodiments.

FIG. 16(*c*) is an example in which the above-mentioned embodiment is applied to a focusing electrode with plural lines of round openings 20. In this case, the emitter 53 at the end in an emitter array is aligned in the corresponding round opening 23 such that the emitter 53 is shifted toward the inner wall of the round opening 23 from the center of the round opening 23. The emitter 54 at the end in an emitter array is aligned in the corresponding round opening 24 such that the emitter 54 is shifted toward the inner wall of the round opening 24 from the center of the round opening 24. The emitters 53 and 54 can emit electron beams to the anode electrode in parallel and without divergence.

Hence, the present embodiment can more narrow the vertical beam width on an anode electrode in comparison with the foregoing embodiments, thus realizing a higher resolution display device.

Figure 17B:
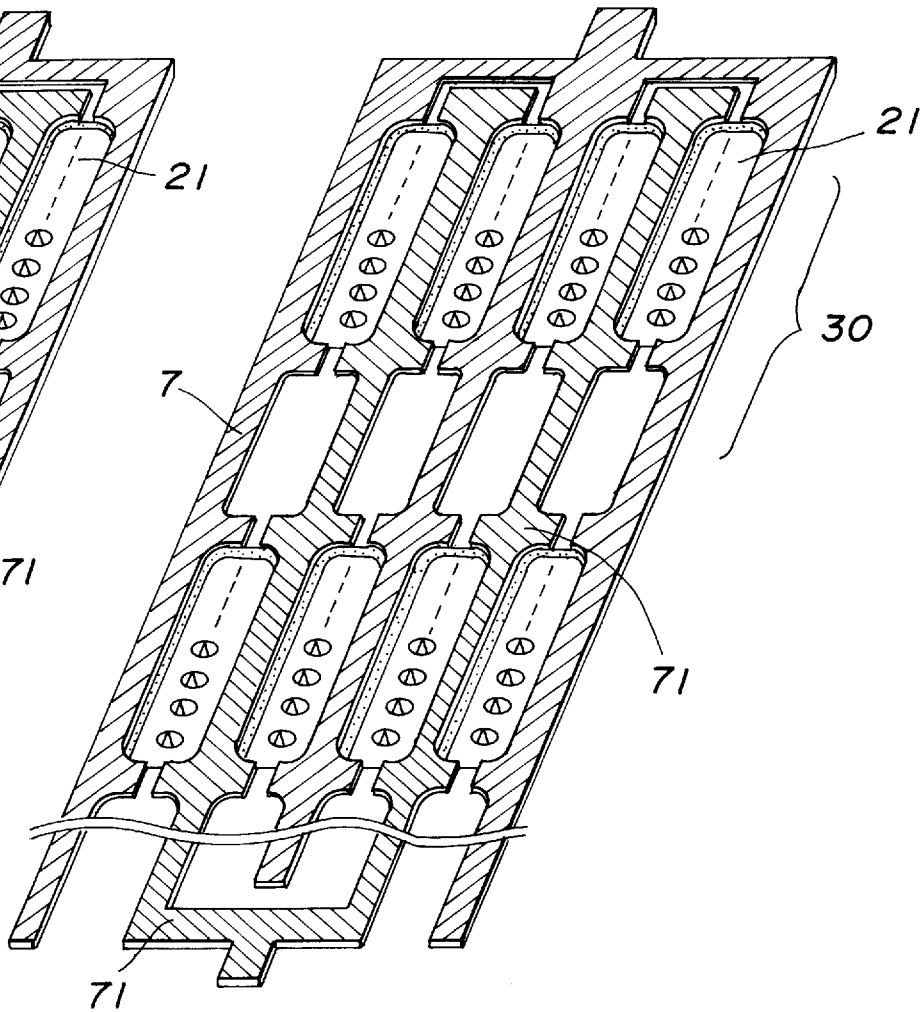
FIGS. 17(*a*) and 7(*b*) are perspective views each showing a field emission cathode in a field emission display device according to still another embodiment of the present invention.
Figure 17A:
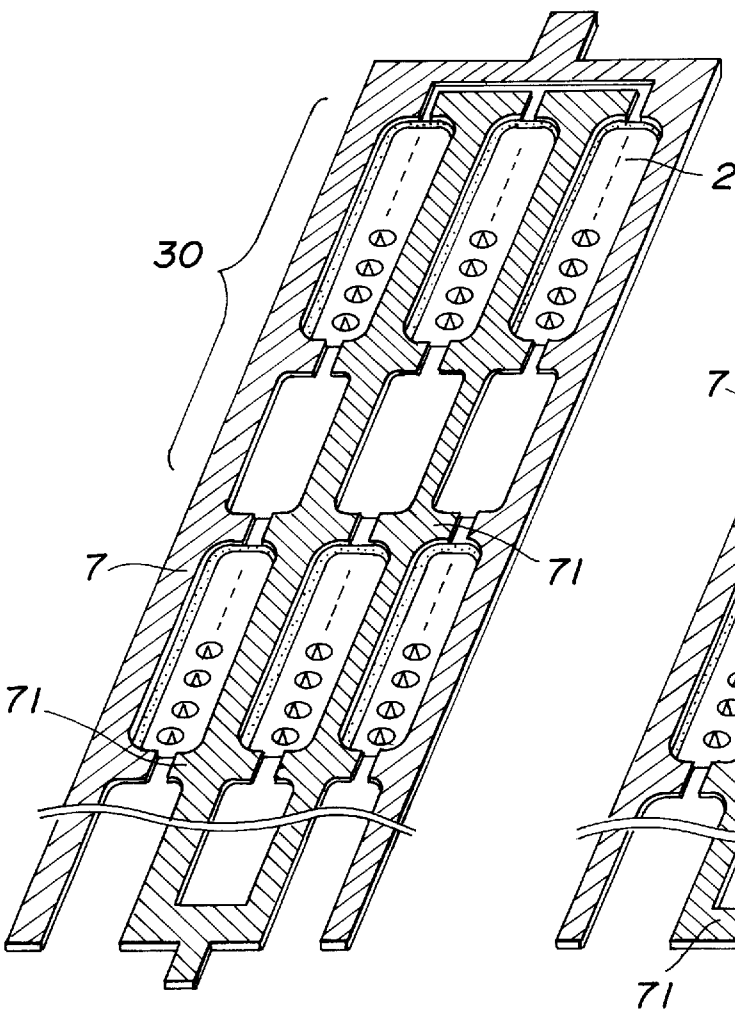

In the above embodiment, three lines of emitters can be embodied to monochrome displays using wider fluorescent substance dots. FIG. 17(*a*) shows an emitter array structure with three emitter lines. FIG. 17(*b*) shows an emitter array structure with four emitter lines. In FIGS. 17(*a*) and 17(*b*), the focusing electrode has slit-like openings 21. However, the focusing electrode may have round openings.

As described above, the cold cathode is formed of cone emitters. According to the present invention, various types of cold cathode can be used without limiting only to the above-mentioned cone emitters.

As described above, in the field emission display device driven on high anode voltages according to the present invention, electrons emitted from a cathode can be focused and suitably diverged on the whole surface of a fluorescent substance dot.

Moreover, since the reduced number of emitters can be integrated in a small area, the cathode-to-anode stray capacitance can be reduced. As a result, the power consumption can be reduced.

Still furthermore, since high voltage and small current areas are utilized to provide a high fluorescent substance luminous efficiency, the cathode-to-gate voltage as well as cathode-to-gate current can be reduced.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission display device, comprising:

a cathode substrate on which cathode electrodes are formed;

emitters arranged on each of said cathode electrodes;

first gate electrodes each having respective first openings and respectively placed near said emitters, for extracting electrons through said first openings;

second gate electrodes each having a respective second opening for focusing electrons, said second opening being formed above a first gate electrode a distance L2 from said first gate electrode apart, the shortest distance between the edge of the second opening and the center of one of said emitters being set to d1; and an anode substrate arranged so as to confront said cathode substrate, said anode substrate having anode electrodes each on which a fluorescent substance is coated;

wherein said distance d1 is expressed by the inequality of $0.5\ d \leqq d1 \leqq 3\ d$, where d is a divergent radius of the locus of electrons emitted from said emitter a distance L2 away from said emitter in the case of the existence of no second gate electrode.

2. The field emission display device as defined in claim 1, wherein each of said emitters is placed in said second opening, said second opening being a round opening.

3. The field emission display device as defined in claim 2, wherein each of said emitters is placed at a position somewhat shifted from the center of said round opening.

4. The field emission display device as defined in claim 2, wherein plural rows of said round openings are arranged for one pixel.

5. The field emission display device as defined in claim 3, wherein plural lines of said round openings are arranged for one pixel.

6. The field emission display device as defined in claim 1, wherein said second opening is a slit-like opening and wherein a line of plural emitters are placed oppsite said slit-like opening.

7. The field emission display device as defined in claim 6, wherein said line at plural emitters is placed at a position somewhat shifted from the center of said slit-like opening.

8. The field emission display device as defined in claim 6, wherein said slit-like opening is formed of plural subslits.

9. The field emission display device as defined in claim 7, wherein said slit-like opening is formed of plural subslits.

10. The field emission display device as defined in any one of claims 6 to 9, further comprising plural slit-like openings formed in parallel for one pixel.

11. The field emission display device as defined in any one of claims 6 to 9, wherein an emitter positioned at the end of a line of said emitters arranged in said slit-like opening is arranged adjacent to the end of said slit-like opening.

12. The field emission display device as defined in any one of claims 1 to 9, wherein each said second sate electrode is electrically divided into two segments interleaving said second opening between said two segments, and a different voltage is applied to each of said two segments.

13. The field emission display device as defined in claim 10, wherein an emitter positioned at the end of a line of said emitters arranged in said slit-like opening is arranged adjacent to the end of said slit-like opening.

14. The field emission display device as defined in claim 10, wherein each said second gate electrode is electrically divided into two segments interleaving said second opening between said two segments, and a different voltage is applied to each of said two segments.

15. The field emission display device as defined in claim 11, wherein each said second gate electrode is electrically divided into two segments interleaving said second opening between said two segments, and a different voltage is applied to each of said two segments.

* * * * *